US012447370B1

(12) United States Patent
Gao

(10) Patent No.: US 12,447,370 B1
(45) Date of Patent: Oct. 21, 2025

(54) HAND GRIP STRENGTHENER WITH RESISTANCE LEVEL INDICATION

(71) Applicant: MACBO TECHNOLOGIES LLC, Denver, CO (US)

(72) Inventor: Yiming Gao, Shenzhen (CN)

(73) Assignee: MACBO TECHNOLOGIES LLC, Denver, CO (US)

( * ) Notice: Subject to any disclaimer, the term of this patent is extended or adjusted under 35 U.S.C. 154(b) by 0 days.

(21) Appl. No.: 18/773,484

(22) Filed: Jul. 15, 2024

(51) Int. Cl.
*A63B 21/00* (2006.01)
*A63B 21/02* (2006.01)
*A63B 23/16* (2006.01)

(52) U.S. Cl.
CPC ..... *A63B 21/00069* (2013.01); *A63B 21/023* (2013.01); *A63B 21/4035* (2015.10); *A63B 23/16* (2013.01)

(58) Field of Classification Search
CPC ..... A63B 21/00069; A63B 21/4035; A63B 21/023; A63B 23/16; A63B 21/045; A63B 2071/0694; A63B 21/0722; A63B 21/0724; A63B 21/0728; A63B 21/075; A61H 2201/1635; A61H 2205/065
See application file for complete search history.

(56) References Cited

U.S. PATENT DOCUMENTS 4,027,535 A * 6/1977 Swanson ..... A61B 5/224 73/491
2019/0336823 A1* 11/2019 Assad ..... A63B 21/028

FOREIGN PATENT DOCUMENTS

CN 1608695 A * 4/2005 ..... A63B 23/16
CN 206304302 U * 7/2017

* cited by examiner

*Primary Examiner* — Loan B Jimenez
*Assistant Examiner* — Jacqueline N L Loberiza
(74) *Attorney, Agent, or Firm* — Che-Yang Chen

(57) ABSTRACT

A hand grip strengthener includes two operation arms, a strength adjustment assembly, a scale display element having a plurality of resistance level scales, and an indication element, the strength adjustment assembly includes a spring element, a spring driving element, and an adjustment control element, when the adjustment control element is operated by the user, the spring driving element is driven to move, so as to drive the spring element to move to adjust the resistance force applied to the relative movement between the two operation arms, the indication element is arranged to move along with the movement of the spring driving element, so as to be selectively aligned with the plurality of resistance level scales.

18 Claims, 33 Drawing Sheets

A

B

C

D

E

F

HAND GRIP STRENGTHENER WITH RESISTANCE LEVEL INDICATION

BACKGROUND OF THE PRESENT INVENTION

Field of Invention

The present invention relates to hand grip trainer, and more particular to a hand grip strengthener with resistance level indication.

Description of Related Arts

A hand grip strength device can enhance the strength of the muscles in the hands, fingers, wrists, and forearms. This is beneficial for various daily activities and sports that require a strong grip. Regular grip training can improve the endurance of the hand and forearm muscles, allowing for prolonged activities without fatigue for athletes, musicians, and professionals who use their hands extensively. Hand grip exercises can also be used in physical therapy to aid in the rehabilitation of hand and wrist injuries, helping to restore strength, flexibility, and range of motion after injury or surgery. Furthermore, squeezing a hand grip strength device can be a good way to relieve stress and tension. It can serve as a simple and portable stress-relief tool that can be used anywhere.

Currently, a conventional hand grip strength device allows the user to adjust the resistance during usage. However, the current design of the conventional hand grip strength device cannot precisely indicate the resistance level being applied. Without indication of resistance levels, the user cannot accurately monitor his or her progress. This makes it difficult to see improvements or set specific goals, leading to a lack of motivation and potentially slower development of grip strength. Without clear resistance levels, the user may become discouraged by the lack of tangible progress, leading to decreased commitment to his or her training routine.

It also becomes challenging to quantitatively measure improvements in grip strength. This lack of measurable data can hinder users' ability to adjust their training program effectively.

Not knowing the resistance level can also lead to the use of inappropriate force, increasing the risk of strain or injury. This is especially concerning for beginners who may not be able to judge the correct resistance by feel alone.

In addition, for those using grip strength devices under the guidance of a physical therapist or personal trainer, the lack of resistance levels makes it harder for professionals to assess progress and adjust rehabilitation or training programs accordingly. Users also cannot easily share information or advice on selecting the appropriate resistance level, making it difficult for individuals to compare their progress or follow recommendations from others, leading to potential inefficiency in their training.

SUMMARY OF THE PRESENT INVENTION

The present invention is advantageous in that it provides a hand grip strengthener with resistance level indication which allows the user to see the exact amount of resistance the user is using with the hand grip strengthener. This feature provides a clear, visual display of the resistance setting, so that the user knows the precise resistance level he or she is working with and it helps the user to have a quantitative understanding and knowledge of his or her appropriate resistance for his or her current strength level.

Another advantage of the present invention is to provide a hand grip strengthener with resistance level indication which helps the user to monitor his or her progress and adjust his or her workouts as needed. The ability to see and adjust resistance levels provides a clear way to track progress over time, which can be motivating and satisfying for the user. The user can set specific goals based on resistance levels, making it easier to plan and achieve fitness milestones.

Another advantage of the present invention is to provide a hand grip strengthener with resistance level indication, wherein knowing the resistance level helps the user to make informed decisions about his or her training intensity, especially important for beginners or those recovering from injuries.

Another advantage of the present invention is to provide a hand grip strengthener with resistance level indication which allows users to share their preferred settings with each other, making it easier to communicate about their workouts. Additionally, it enables professionals or personal trainers to provide more detailed and precise guidance, helping users to achieve their fitness goals more effectively.

Another advantage of the present invention is to provide a hand grip strengthener with resistance level indication, wherein an indication element is provided on a spring driving element which is driven to move during resistance adjustment, the indication element is viewable by the user and can be aligned to and pointed to a position corresponding to or adjacent to a predetermined resistance scale when in a stopping position, so as to inform the user the current using resistance level.

Additional advantages and features of the invention will become apparent from the description which follows, and may be realized by means of the instrumentalities and combinations particularly pointing out in the appended claims.

According to the present invention, the foregoing and other objects and advantages are attained by a hand grip strengthener, comprising:

- a first operation arm;
- a second operation arm;
- a strength adjustment assembly comprising a spring element, a spring driving element, and an adjustment control element, wherein the spring element is arranged to generate a resistance force to the relative movement between the first operation arm and the second operation arm, wherein when the adjustment control element is operated by the user, the spring driving element is driven to move, so as to drive the spring element to move to adjust the resistance force;
- a scale display element comprising a base arm and a plurality of resistance level scales provided on the base arm; and
- an indication element which is arranged to move along with the movement of the spring driving element, so as to be selectively aligned with the plurality of resistance level scales.

According to an embodiment, the adjustment control element comprises an adjusting knob and a driving shaft coupled to the adjusting knob, wherein the spring driving element comprises a moving member which is screwed on the driving shaft in a manner that when the adjusting knob is rotated, the driving shaft is rotating to drive the moving member to move, so as to drive the spring element to move.

According to an embodiment, the base arm has an elongated window which allows the user to view the indication element.

According to an embodiment, the indication element is provided on the moving member at a side facing toward the window.

According to an embodiment, the indication element comprises a color marking which is provided on the moving member.

According to an embodiment, the moving member comprises a ring body which is wound around the driving shaft, and a protruding block which is extended from the ring body, wherein the color marking is formed on the protruding block.

According to an embodiment, the base arm has a channel, wherein the driving shaft is disposed in the channel, wherein the window is communicated to the channel, wherein the protruding block has a flat surface facing toward the window, wherein the color marking is formed on the flat surface of the protruding block.

According to an embodiment, the indication element and the moving member are disposed in the channel.

According to an embodiment, the moving member is disposed in the channel, at least a part of the protruding block is extended into the window, wherein the color marking is provided in the window, so as to move in the window.

According to an embodiment, the indication element comprises a pointer arm connected to the moving member.

According to an embodiment, the indication element comprises a pointer arm connected to the spring element.

According to an embodiment, the pointer arm and the moving member are disposed in the channel, so as to be driven to move in the channel.

According to an embodiment, the pointer arm is extended into the window, so as to be driven to move in the window, the moving member is disposed in the channel, so as to be driven to move in the channel.

According to an embodiment, the indication element comprises a connecting arm connected to the moving member and a pointer arm transversely connected to the connecting arm, wherein the connecting arm is penetrating through the window to allow the pointer arm to be provided at an outer side of the base arm.

According to an embodiment, the base arm has a channel and an upper groove communicated to the channel, wherein the moving member is disposed in the channel, wherein the indication element comprises a connecting arm connected to the spring driving element and a pointer arm downwardly extended from the connecting arm, wherein the pointer arm is provided at a position at an outer side of the upper groove, wherein the plurality of resistance level scales is provided on a side surface of the base arm.

According to an embodiment, the base arm has a channel and an upper groove communicated to the channel, wherein the moving member is disposed in the channel, wherein the indication element comprises a connecting arm connected to the spring element and a pointer arm downwardly extended from the connecting arm, wherein the pointer arm is provided at a position at an outer side of the upper groove, wherein the plurality of resistance level scales is provided on a side surface of the base arm.

According to an embodiment, the base arm has a channel and an upper groove communicated to the channel, wherein the moving member is disposed in the channel, wherein the plurality of resistance level scales is provided on a top surface of the base arm, wherein the indication element comprises a color marking formed on the moving member and is viewable through the upper groove.

According to an embodiment, the base arm has a channel and an upper groove communicated to the channel, wherein the moving member is disposed in the channel, wherein the plurality of resistance level scales is provided on a top surface of the base arm, wherein the indication element comprises a pointer arm connected to the moving member and is movable in the upper groove.

According to an embodiment, the base arm has a channel and an upper groove communicated to the channel, wherein the moving member is disposed in the channel, wherein the base arm has two groove walls for forming the upper groove, wherein the plurality of resistance level scales is provided on one of the groove walls, wherein the indication element is connected to the moving member and is configured to be movable in the upper groove.

According to an embodiment, the strength adjustment assembly further comprises a spring mounting element which is connected to a top of the second operation arm, wherein the spring element is inclined connected between the spring driving element and the spring mounting element.

According to an embodiment, the first operation arm is connected to the base arm, wherein the base arm is movably connected to the second operation arm.

According to an embodiment, the strength adjustment assembly further comprises a spring mounting piece disposed in the base arm, wherein the spring element comprises a fixing end portion which is mounted to the spring mounting piece which is slidably arranged on the driving shaft, wherein the first operation arm is movably coupled with the second operation arm and comprises an upper end portion which is biasing against the spring mounting piece, wherein the spring element is connected between the moving member and the spring mounting piece.

According to an embodiment, the base arm has a channel and an upper groove communicated to the channel, wherein the moving member is disposed in the channel, wherein the plurality of resistance level scales is provided on top of the base arm, wherein the indication element is provided on the moving member and is viewable through the upper groove.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
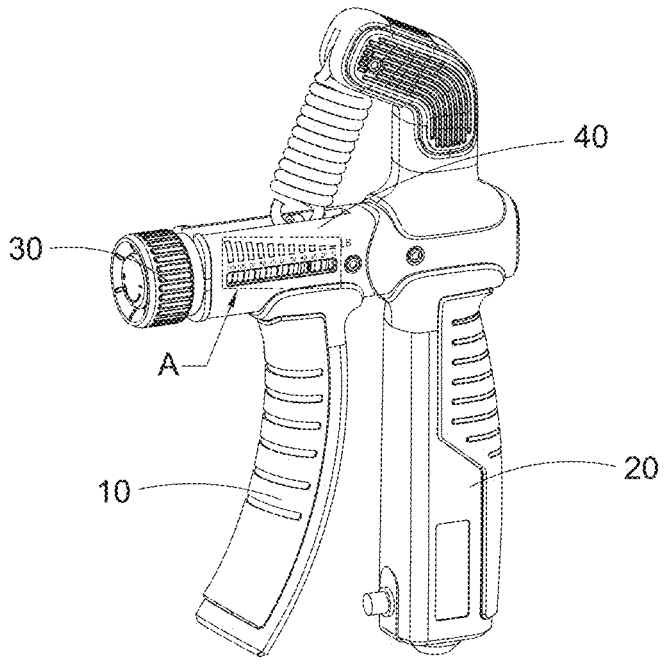
FIG. 1 is a perspective view of a hand grip strengthener according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Referring to FIG. 1 to FIG. 5 of the drawings, a hand grip strengthener with resistance level indication according to a first preferred embodiment of the present invention is illustrated, wherein the hand grip strengthener comprises a first operation arm 10, a second operation arm 20, a strength adjustment assembly 30, and a resistance level indication assembly 40 which comprises a scale display element 41 and an indication element 42 for indicating a current resistance level to a user when the strength adjustment assembly 30 is operated for adjusting the resistance.

The first operation arm 10 is coupled with the second operation arm 20 for a hand of a user to grip thereon and the two operation arms 10 and 20 are capable of being moved away from or close to each other. The strength adjustment assembly 30 is coupled to one of the operations arms to adjust the resistance for the user, the scale display element 41 of the resistance level indication assembly 40 comprises a scale display area 410 for displaying a plurality of resistance level scales 411, and the indication element 42 can be driven to move during the strength adjustment process by the strength adjustment assembly 30, so as to allow the indication element 42 to point to a position within the scale display area 410, so that the user can view his or her current resistance level. In other words, as the user adjusts the resistance using the strength adjustment assembly 30, the indication element 42 moves accordingly and point to the corresponding resistance level on the scale display area 410 when the movement is stopped, so as to allow the user to easily acknowledge his or her current resistance level.

According to this embodiment, the strength adjustment assembly 30 comprises a spring element 31, a spring driving element 32, and an adjustment control element 33. The spring element 31 is arranged to generate a resistance force to the relative movement between the first operation arm 10 and the second operation arm 20, the adjustment control element 33 can be operated by the user, so as to drive the spring driving element 32 to move, and thus the spring element 31 is driven to move and deform, so as to adjust the resistance force.

The strength adjustment assembly 30 further comprises a spring mounting element 34 for mounting the spring element 31. More specifically, the spring element 31 comprises a moving end portion 311, a fixing end portion 312, and a spring body 313 extended between the moving end portion 311 and the fixing end portion 312. The fixing end portion 312 is an end portion that is opposite to the moving end portion 311 and is fixed to the spring mounting element 34. In this embodiment, the spring mounting element 34 is connected to a top of the second operation arm 20, and the spring element 31 is inclinedly extended between the spring mounting element 34 and the scale display element 41.

Figure 2:
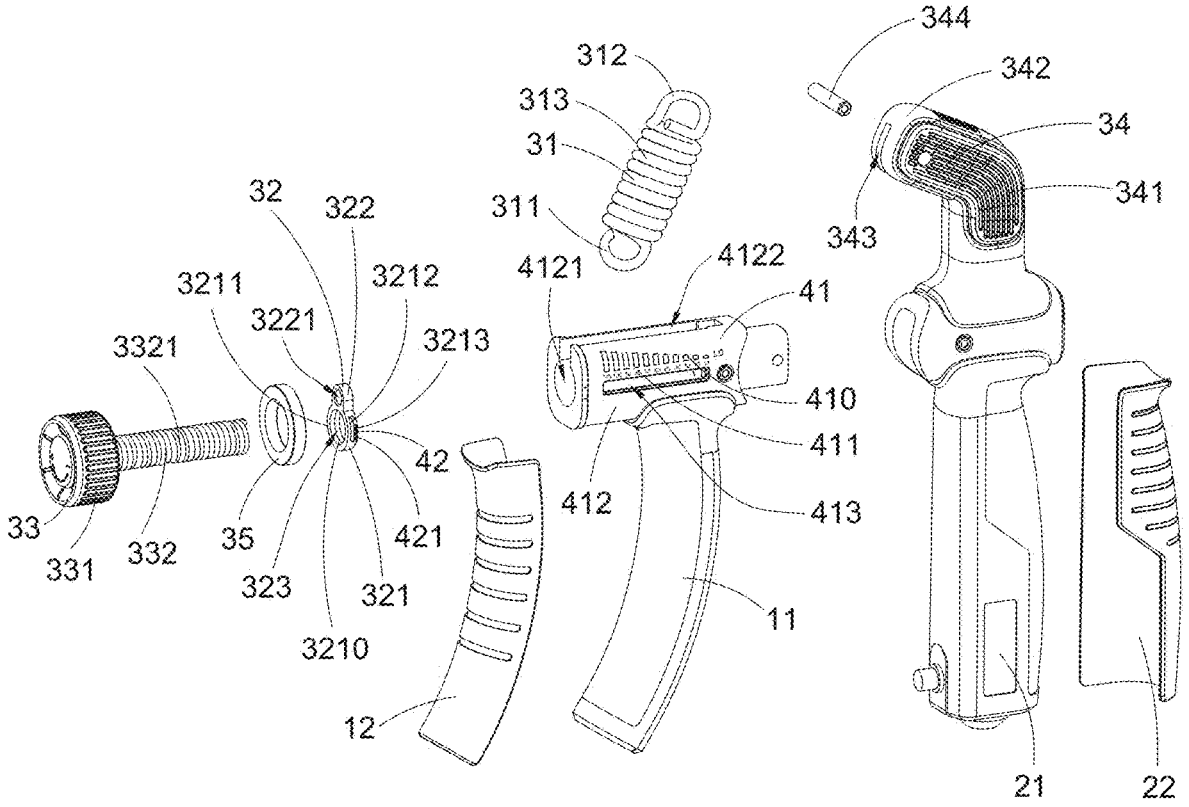
FIG. 2 is an exploded view of the hand grip strengthener according to the above first preferred embodiment of the present invention.

As shown in FIG. 2 of the drawings, the moving end portion 311 and the fixing end portion 312 can be hook end portions which are respectively connected to the spring driving element 32 and the spring mounting element 34.

As shown in FIG. 2 of the drawings, the spring mounting element 34 comprises an extending portion 341 which is extended from the top of the second operation arm 20 and a connecting portion 342 which is inclinedly or curvedly extended from the extending portion 341 for mounting the fixing end portion 312 of the spring element 31.

The connecting portion 342 has a connecting groove 343 for disposing the fixing end portion 312 of the spring element 31, a connecting pin 344 can be penetrating through the fixing end portion 312 of the spring element 31 and the connecting portion 342 for mounting the fixing end portion 312 of the spring element 31 to the connecting portion 342 of the spring element 34. The person of ordinary skilled in the art should understand the above connecting manner between the connecting portion 342 of the spring mounting element 34 and the fixing end portion 312 of the spring element 31 is exemplary only and is not intended to be limiting.

The adjustment control element 33 comprises an adjusting knob 331 and a driving shaft 332 connected to the adjusting knob 331, the spring driving element 32 is movably coupled on the driving shaft 332 in a manner that when the adjusting knob 331 is rotated, the spring driving element 32 will be driven to move by the driving shaft 332, so as to further drive the moving end portion 311 of the spring element 31 to move, so that the spring body 313 is deformed into different tension states to generate different resistances to the relative movement between the first operation arm 10 and the second operation arm 20.

The driving shaft 332 comprises outer threads 3321 on an outer surface thereof, the spring driving element 32 comprises a moving member 321 wound around the driving shaft 332 and a driving member 322 connected to the moving member 321 for driving the movement of the moving end portion 311 of the spring element 31.

The moving member 321 has a central hole 323 and comprises inner threads 3210 on an inner ring surface around the central hole 323 thereof for engaging with the outer threads 3321 of the driving shaft 332, so that the moving member 321 is screwed on the driving shaft 332. Therefore, when the adjusting knob 331 is rotated, the driving shaft 332 will be rotating, and the moving member 321 will be driven to move along the driving shaft 332 because of the screwing connection between the driving shaft 332 and the moving member 321, and thus the moving end portion 311 of the spring element 31 connected to the driving member 332 will be driven to move to adjust its position to result in the deformation of the spring body 313, so that the stretched state of the spring body 313 is adjusted, and thus the adjustable resistance of the hand grip strengthener can be provided.

In this embodiment, the spring element 31 can be a compression spring, the movement of the moving end portion 311 of the spring element 31 will result in different stretching states of the compression spring, so as to adjust the resistance of the spring element 31 applied to the relative movement between the first operation arm 10 and the second operation arm 20.

The driving member 322 has a connecting hole 3221, the moving end portion 311 of the spring element 31 is hooked on the driving member 322 by passing through the connecting hole 3221, so that the spring element 31 is connected to the driving member 322 of the spring driving element 32. The person of ordinary skilled in the art should understand that the connecting manner between the driving member 322 and the spring element 31 is exemplary only, and is not intended to be limiting.

The adjustment control element 33 may further comprise a flexible ring 35 which is arranged between an end portion of the scale display element 41 and the adjusting knob 331. The flexible ring 35 is wound around the driving shaft 332 to block the further inward rotating movement of the adjusting knob 331, prevent the frictional contact between the end portion of the scale display element 41 and the adjusting knob 331, as well as to block the further movement of the spring driving element 32.

Figure 3:
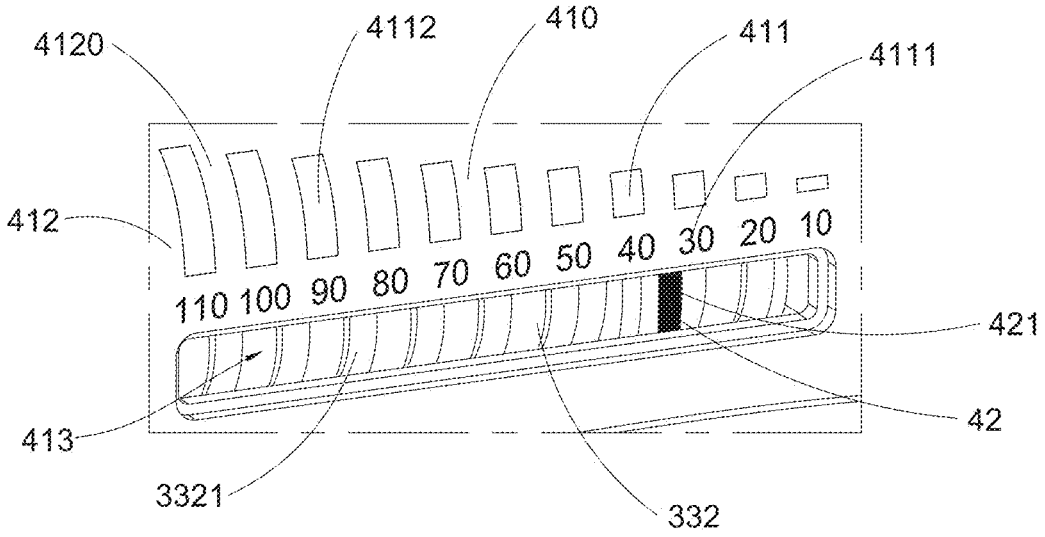
FIG. 3 is a partial enlarged view of area A in FIG. 1.

The scale display element 41 comprises a base arm 412 comprising an outer surface 4120, the scale display area 410 is formed on the side surface 4120 of the base arm 412. As shown in FIGS. 2 and 3 of the drawings, the plurality of resistance scale levels 411 can be marks spacedly painted on the side surface 4120 of the base arm 412 at a front or rear side of the base arm 412.

In this embodiment, unlike conventional hand grip strength trainers with few scale values, the resistance scale levels 411 of the present invention are provided with more scale values, so as to allow the user to know a more precise resistance.

The first operation arm 10 is connected to the base arm 412, the base arm 412 is movably coupled with the second operation arm 20, so as to allow the first operation arm 10 and the second operation arm 20 to be moved close to each other or to be moved away from each other for hand strength exercising.

The first operation arm 10 comprises a first arm body 11 and a first gripping layer 12 provided on the first arm body 11 to enhance slip resistance and provide a comfortable grip of the user. The second operation arm 20 comprises a second arm body 21 and a second gripping layer 22 provided on the second arm body 21 to enhance slip resistance and provide a comfortable grip of the user. Each of the first gripping layer 12 and the second gripping layer 22 can be made of a flexible material.

During an exercise operation of the hand grip strengthener, the second operation arm 20 can be supported in the palm of the user, while the fingers of the gripping hand of the user can be gripped on the first operation arm 10 to apply a pressing force to the first operation arm 10. Alternatively, the user may user different fingers of an operating hand of the user to carry out the hand grip strength training. As an example, the thumb of the operating hand of the user can be pressed on the second operation arm 20 while one or more other fingers of the operating hand of the user can be placed on the first operation arm 10, and the operating fingers can be moved to drive the relative movement between the two operation arms 10 and 20.

According to this embodiment, the base arm 412 may comprise an end portion which is pivotally coupled to the second operation arm 20, so as to allow the pivotal movement between the first operation arm 10 and the second operation arm 20. Alternatively, the first operation arm 10 and the second operation arm 20 are configured to allow a linear relative movement.

As shown in FIG. 3 of the drawings, each of the resistance scale levels 411 may comprise a scale value 4111 and a scale bar 4112 for representing a magnitude of the resistance by its length. As the example shown in FIG. 3, the plurality of scale values 4111 can be ranged from 10 lbs to 110 lbs. In this embodiment, the minimum scale value 10 lbs is painted on the side surface 4120 of the base arm 412 at a side away from the adjusting knob 331, i.e. the right side of the hand grip strengthener; the maximum scale value 110 lbs is painted on the side surface 4120 of the base arm 412 at a side adjacent to the adjusting knob 331, i.e. the left side of the hand grip strengthener.

The base arm 412 has a channel 4121 and an upper groove 4122 communicated to the channel 4121, the driving shaft 332 of the adjustment control element 33 is extended into the channel 4121 of the base arm 412 and is movable in the channel 4121. The driving member 322 of the spring driving element 32 is movable along the upper groove 4122 of the base arm 412, so as to drive the moving end portion 311 of the spring element 31 to move along the upper groove 4122 of the base arm 412.

The scale display element 41 further has an elongated window 413 formed in the base arm 412 for exposing the indication element 42 which is provided on the spring driving element 32. The window 413 is extended along a length of the base arm 412 and is provided at a position below or above the plurality of resistance level scales 411.

The indication element 42 of this embodiment can be a color marking 421 which is formed on the moving member 321, so that when the moving member 321 is driven to move in the channel 4121 of the base arm 412 along the driving shaft 332 of the adjustment control element 33, the color marking 421 will be simultaneously driven to move along with the moving member 321 of the spring driving element 32, and thus the color marking 421 can be moved to align its position with one of the resistance level scales 411 or align its position to a middle position between two adjacent resistance level scales 411 when the movement of the spring driving element 32 and the color marking 421 is stopped, so that the user can know the precise resistance level he or she is working with.

According to this embodiment, as shown in FIG. 2, the moving member 321 comprises a ring body 3211 which is screwed on the driving shaft 332 of the adjustment control element 33, and an protruding block 3212 which is protruded on the ring body 3211 at a side facing toward the window 413, the protruding block 3212 comprises a flat surface 3213 which is used to be painted with the color marking 421, so that the color marking 421 is displayed in a plane, making it easy for a user to view.

The color marking 421 can be but not limited to a red marking, a green marking, a yellow marking, white marking, a blue marking, a brown marking, a purple marking, or a black marking. The color marking 421 is applied on the moving member 321 with a color that is different from the driving shaft 332 of the adjustment control element 33, so that the color marking 421 is distinguishable from the driving shaft 332, making it easy to be recognized by the user. Furthermore, it it preferred that color marking 421 has a color that is different from the base arm 412 of the scale display element 41, so that the color marking 421 is distinguishable from the base arm 412 of the scale display element 41. In addition, it is further preferred that the color of the color marking 421 is distinguishable from the resistance level scales 411, so that the user is able to identify the color marking 421 from the resistance level scales 411.

As shown in FIG. 3 of the drawing, a shape of the color marking 421 can be a bar shape. A person of ordinary skilled in the art should understand that the color marking 421 can be embodied into other shape such as an arrow shape.

The method for forming the color marking 421 on the moving member 321 of the spring driving element 32 is also not limited. The color marking 421 can be painted on the moving member 321. In other words, a liquid paint can be sprayed, brushed, or dipped onto the moving member 321 which can be made of rigid material such as plastic, metal and metal alloy. The paint is then dried and cured, forming a colored coating.

Anodizing also can be used for forming the coloring marking 421 on the moving member 321 of the spring driving element 32. More specifically, the anodizing process is an electrochemical process that converts the metal surface of the moving member 321 into a durable, corrosion-resistant, anodic oxide finish. This technique is commonly used on metal such as aluminum and allows for the incorporation of various colors through dyeing. The process involves immersing the metal in an acid electrolyte bath and passing an electric current through the medium.

Powder coating, which involves applying a dry powder to the metal surface electrostatically and then curing it under heat to form a protective layer, also can be employed for forming the color marking 421. This method provides a uniform, durable, and high-quality finish that can be produced in a wide range of colors and textures.

In electroplating process, coating the surface of the moving member 321 can be coated with a thin layer of another metal by using an electric current, so as to form the color marking 421 with colored finishes.

Chemical etching involves using acid or other chemicals to remove material and create patterns on the metal surface of the moving member 321, this etched surface can then be filled with colored inks or dyes to create durable color marking 421.

The color marking 421 can also be prepared by laser marking which uses a laser beam to create a permanent mark on the surface of the moving member 321. This can include engraving, etching, and annealing. Laser marking can produce high-contrast and precise colored marks, depending on the processed material and the laser settings.

In a hot stamping process, a colored foil can be pressed onto the surface of the moving member 321 using heat and pressure, so as to form the color marking 421.

In this embodiment, the color marking 421 is printed on the protruding block 3212 of the moving member 321 and is provided in the channel 4121, so that when the moving member 321 is driven to move in the channel 4121, the color making 421 is also moving in the channel 4121, and the window 413 communicated to the channel 4121 allows the user to view the color marking 421 in the channel 4121. When the moving member 321 is stopped moving, the color marking 421 in the channel 4121 is aligned to a position in the scale display area 410 on the base arm 412, so that the user is provided with a more precise resistance level information.

Figure 4:
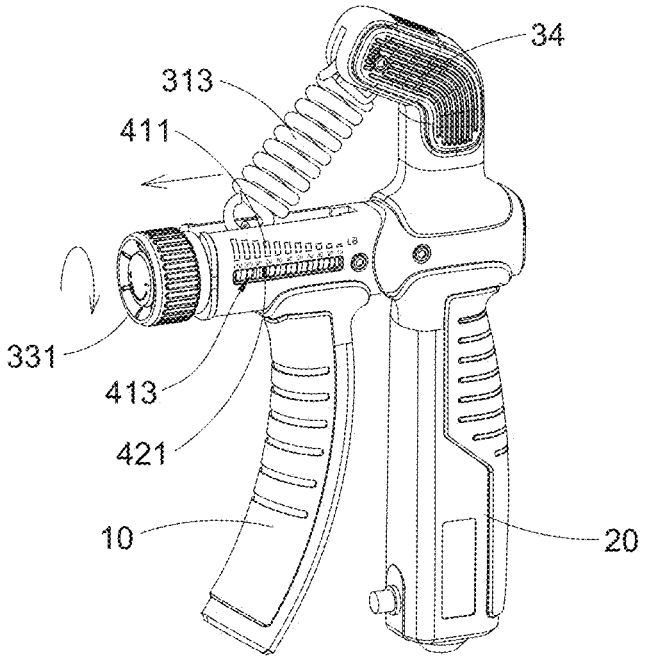
FIG. 4 is a perspective view illustrating the resistance level indication of the hand grip strengthener according to the above first preferred embodiment of the present invention.
Figure 5:
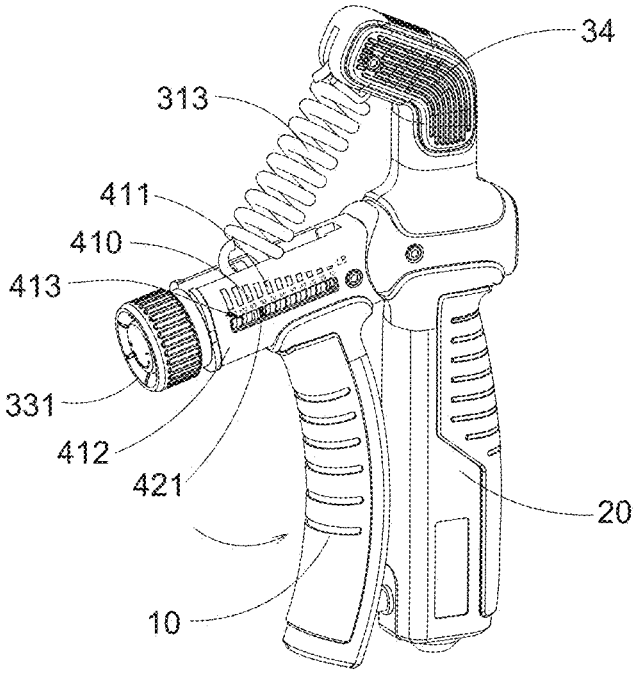
FIG. 5 is a perspective view illustrating the operation of two operation arms of the hand grip strengthener according to the above first preferred embodiment of the present invention.

With reference to FIG. 4 of the drawings, when the color marking 421 and the moving member 321 is moved toward a position adjacent to the spring mounting element 34, the resistance of the spring element 31 applied to the relative movement of the first operation arm 10 and the second operation arm 20 is reduced, and the color marking 421 is aligned to a smaller scale value 4111 and a scale bar 4112 with a smaller length. When the color marking 421 and the moving member 321 is moved toward a position adjacent to the adjusting knob 331, the resistance of the spring element 31 applied to the relative movement of the first operation arm 10 and the second operation arm 20 is increased, and the color marking 421 is aligned to a larger scale value 4111 and a scale bar 4112 with a larger length.

Accordingly, the alignment between the indication element 42 and the resistance level scales 411 provides a visual display of the resistance setting of the hand grip strengthener, rendering the user to have a quantitative understanding and knowledge of his or her current strength level and help the user to identify a suitable precise strength level scale for his or her actual hand situation.

During an exercise period, the resistance set up for each exercising day can be noted, so that the user is able to monitor his or her progress, and the workout plans can be adjusted as needed. When the user is exercising under the teaching of a professional trainer, the professional trainer is able to give the user a more precise guiding advice. In addition, the user is able to share his or her precise resistance setting information with his or her friends, so that it is beneficial for the interaction between a group of users.

Figure 6:
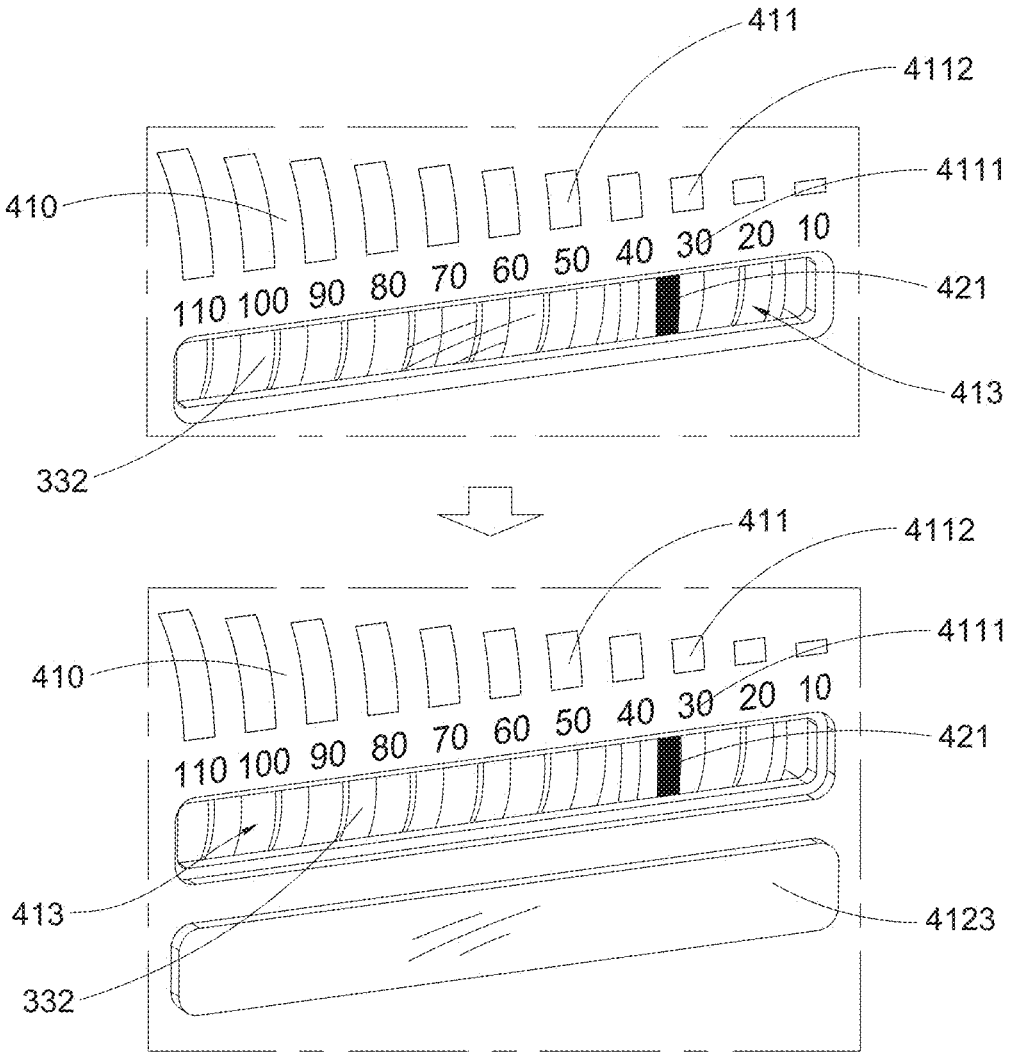
FIG. 6 are partial enlarged views illustrating a hand grip strengthener according to a first alternative mode of the above first preferred embodiment of the present invention.

Referring to FIG. 6 of the drawings, according to a first alternative mode, the base arm 412 further comprises a transparent cover 4123 mounted to a position corresponding to the window 413, so as to cove the window 413 while still allow the user to view the color marking 421 of the indication element 42 from the outer side of the scale display element 41. In other words, when the color marking 421 of the indication element 42 is moving in the channel 4121 of the base arm 412, the user can see through the transparent cover 4123 to determine the position of the color marking 421 of the indication element 42.

Figure 7A:
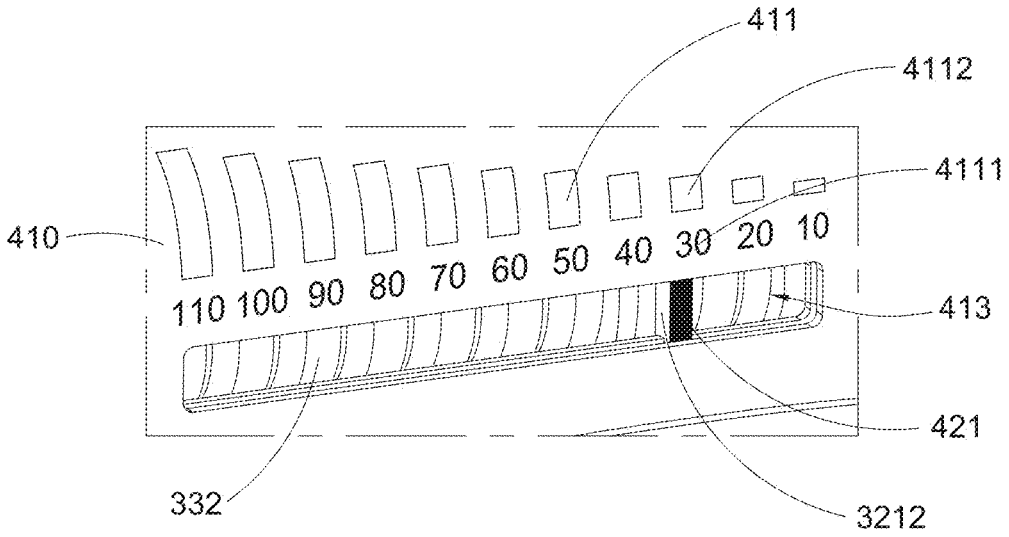
FIG. 7A is an partial enlarged view illustrating a hand grip strengthener according to a second alternative mode of the above first preferred embodiment of the present invention.

Referring to FIG. 7A of the drawings, according to a second alternative mode, at least a part of the protruding block 3212 of the moving member 321 is extended into the window 413. Correspondingly, the color marking 421 of the indication element 42 is also extended into the window 413, so that the position of the color marking 421 is more close to the side surface 4120 of the base arm 412, so that the color marking 421 is adjacent to the resistance scale levels 411.

Accordingly, when the ring body 3211 of the moving member 321 is driven to move in the channel 4121 of the base arm 412, the part of the protruding block 3212 of the moving member 321 is sliding along the elongated window 413, so that the color marking 421 of the indication element 42 is simultaneously moving in the elongated window 413 to selectively align its position with the resistance scale levels 411, and the position of the moving end portion 311 of the spring element 31 is adjusted, so that the resilient force of the spring element 31 is adjusted to adjust the resistance applied to the relative movement of the first operation arm 10 and the second operation arm 20.

Figure 7B:
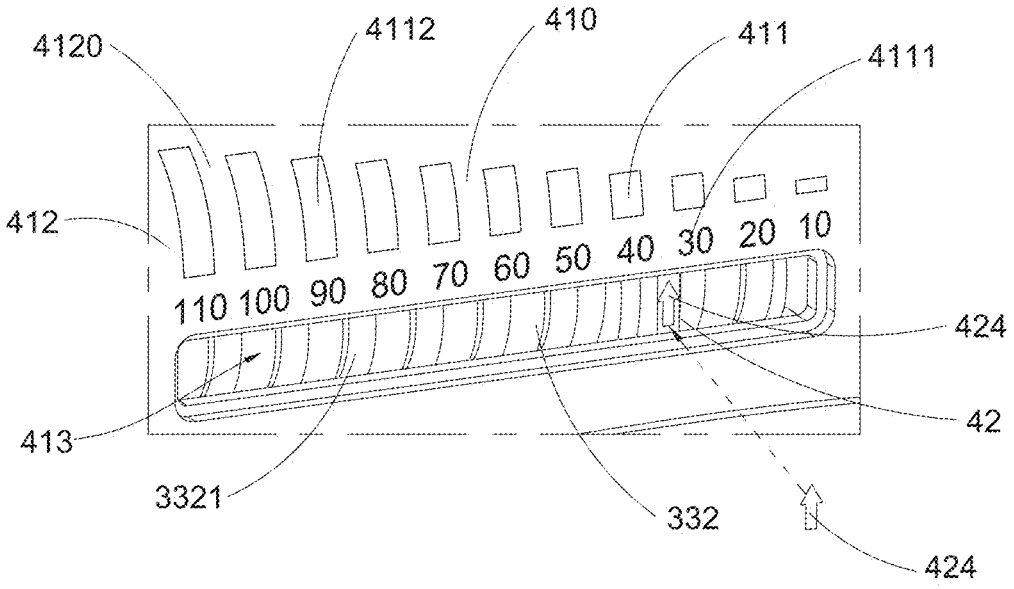
FIG. 7B is an partial enlarged view illustrating a hand grip strengthener according to a third alternative mode of the above first preferred embodiment of the present invention.

Referring to FIG. 7B of the drawings, according to a third alternative mode, the indication element 42 comprises an attaching layer 424 which is provided with the color marking 421, and the attaching layer 424 can be attached on the protruding block 3212 of the moving member 321 by a glue.

Figure 7C:
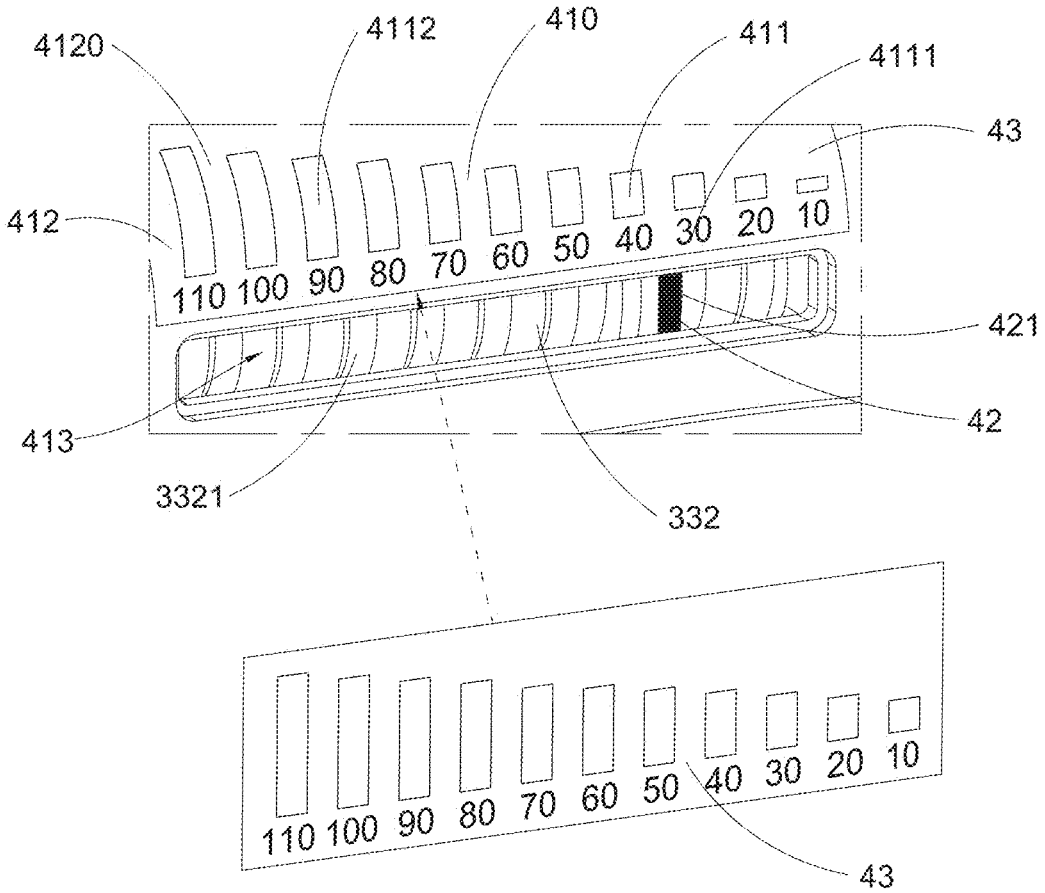
FIG. 7C is an partial enlarged view illustrating a hand grip strengthener according to a fourth alternative mode of the above first preferred embodiment of the present invention.

Referring to FIG. 7C of the drawings, according to a fourth alternative mode, an adhering layer 43 with the resistance scale levels 411 can be attached on the side surface 4120 of the base arm 412 by a glue.

Figure 8:
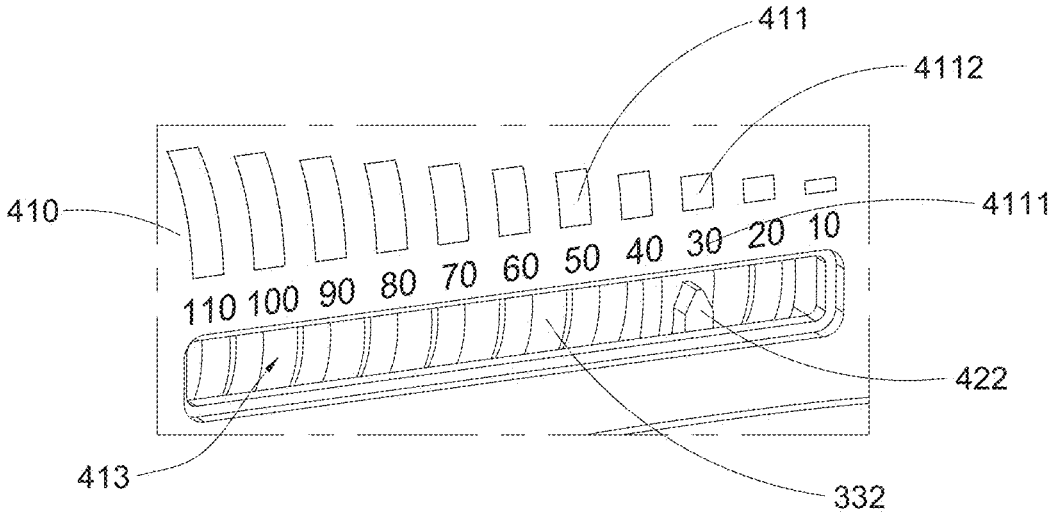
FIG. 8 is an partial enlarged view illustrating a hand grip strengthener according to a fifth alternative mode of the above first preferred embodiment of the present invention.

Referring to FIG. 8 of the drawings, according to a fifth alternative mode, the indication element 42 is not embodied as the color marking 421 in the above embodiments, but can be embodied to comprise a pointer arm 422 which is identifiable by its own shape or configuration. For example, in this embodiment, a part of the pointer arm 422 is shaped like an arrow.

In other words, in this embodiment, the indication element 42 does not employ the color marking 421 for indication, but the shape characteristic of the pointer arm 422. The protruding block 3212 of the moving member 321 in the above embodiment can be shaped and configured to form the pointer arm 422 of this embodiment.

The pointer arm 422 of the indication element 42 can be connected to the ring body 3211 of the moving member 321 and is extended in the channel 4121 of the base arm 412, so as to move along with the ring body 3211 of the moving member 321. In this embodiment, the pointer arm 422 of the indication element 42 is integrally extended from a side of the ring body 3211 of the moving member 321 and is facing towards the window 413 of the base arm 412. Preferably, the outer surface of the pointer arm 422 facing the window 413 is configured to be a flat surface, so as to enhance the visual displaying effect of the pointer arm 422.

With reference to FIG. 8 of the drawings, when the pointer arm 422 and the moving member 321 are moved toward a position adjacent to the spring mounting element 34, the resistance of the spring element 31 applied to the relative movement of the first operation arm 10 and the second operation arm 20 is reduced, and the pointer arm 422 is aligned to a smaller scale value 4111 and a scale bar 4112 with a smaller length. When the pointer arm 422 and the moving member 321 are moved toward a position adjacent to the adjusting knob 331, the resistance of the spring element 31 applied to the relative movement of the first operation arm 10 and the second operation arm 20 is increased, and the pointer arm 422 is aligned to a larger scale value 4111 and a scale bar 4112 with a larger length.

In this embodiment, the pointer arm 422 is disposed in the channel 4121 of the base arm 412 and is movable in the channel 4121. Alternatively, at least a part of the pointer arm 422 can be extended into the window, so that the position of the pointer arm 422 is more close to the side surface 4120 of the base arm 412, so that the pointer arm 422 is adjacent to the resistance scale levels 411, and thus it is easy for the user to identify the alignment between the pointer arm 422 and the resistance scale levels 411.

Figure 9:
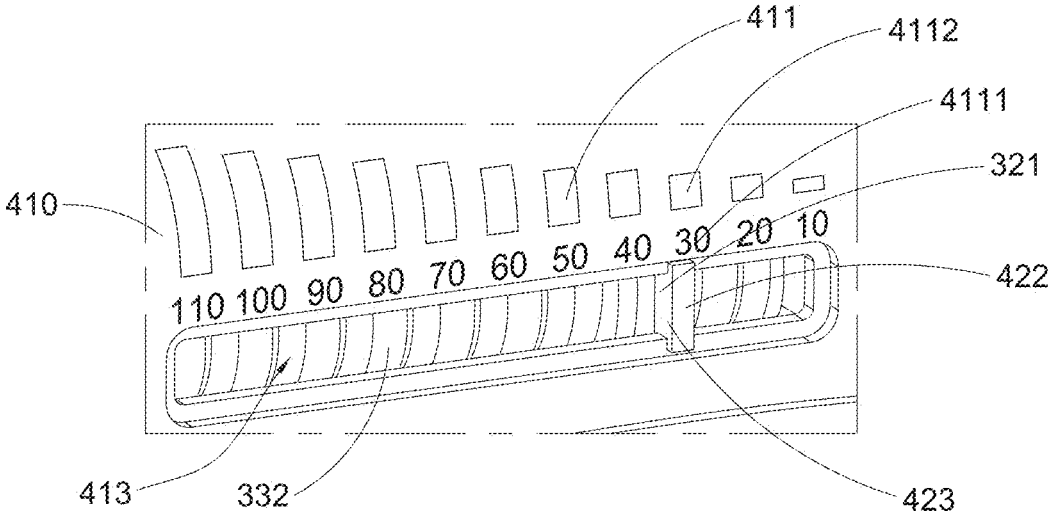
FIG. 9 is an partial enlarged view illustrating a hand grip strengthener according to a sixth alternative mode of the above first preferred embodiment of the present invention.
Figure 10:
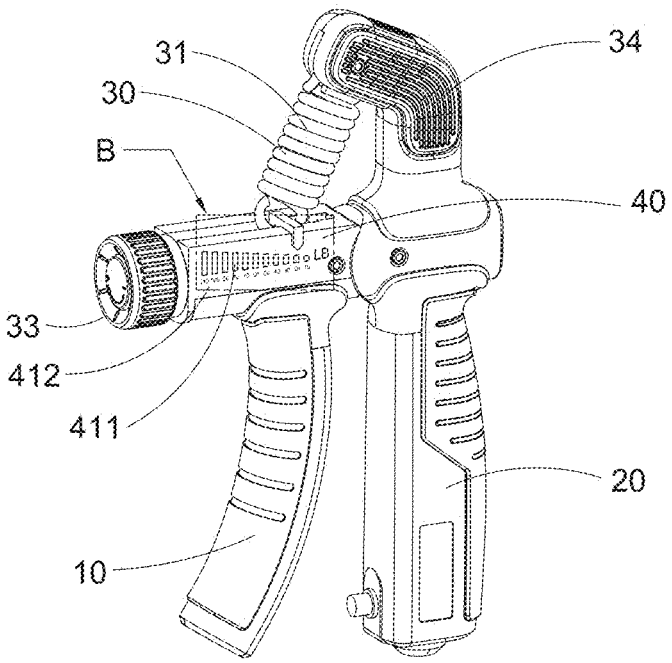
FIG. 10 is a perspective view illustrating a hand grip strengthener according to a seventh alternative mode of the above first preferred embodiment of the present invention.

Referring to FIG. 9 of the drawings, according to a sixth alternative mode, the indication element 42 comprise a pointer arm 422 and a connecting arm 423 which is connected to the ring body 3211 of the moving member 321. In this embodiment, the connecting arm 423 is extended through the window 413 of the base arm 412 and the pointer arm 422, which is extended from the connecting arm 423, is vertical to the window 413 and is at an outer side of the window 413 for being moved to be selectively aligned with the resistance scale levels 411.

In order to facilitate the assembling of the indication element 42, the ring body 3211 of the moving member 321 can be disposed in the channel 4121 of the base arm 412 first, and then the connecting arm 423 of the indication element 42 can be penetrated through the window 413, so as to be mounted to the ring body 3211 of the moving member 321. For example, the connecting arm 423 of the indication element 42 can be screwed on the ring body 3211 of the moving member 321.

It is worth mentioning that the pointer arm 422 is spaced apart from the side surface 4120 of the base arm 412, so that the movement of the pointer arm 422 at an outer side of the window 413 is ensured.

The person of ordinary skilled in the art should understand that the indication element 42 may comprise both of the color marking 421 and the pointer arm 422. In other words, the color marking 421 may be formed on the pointer arm 422, so as to facilitate the user to clearly identify the indication element 42.

Referring to FIGS. 10 to 14 of the drawings, according to a seventh alternative mode, the hand grip strengthener with resistance level indication comprises a first operation arm 10, a second operation arm 20, a strength adjustment assembly 30, and a resistance level indication assembly 40 which comprises a scale display element 41 and an indication element 42 for indicating a current resistance level to a user when the strength adjustment assembly 30 is operated for adjusting the resistance.

In this embodiment, the spring driving element 32 of the strength adjustment assembly 30 comprises a moving member 321 wound around the driving shaft 332 and a driving member 322 connected to the moving member 321 for driving the movement of the moving end portion 311 of the spring element 31.

The scale display element 41 comprises a base arm 412 comprising an side surface 4120, the scale display area 410 is formed on the side surface 4120 of the base arm 412. The base arm 412 has a channel 4121 and an upper groove 4122 communicated to the channel 4121, the driving shaft 332 of the adjustment control element 33 is extended into the channel 4121 of the base arm 412 and is movable in the channel 4121. The driving member 322 of the spring driving element 32 is movable along the upper groove 4122 of the base arm 412, so as to drive the moving end portion 311 of the spring element 31 to move along the upper groove 4122 of the base arm 412.

The indication element 42 comprises a connecting arm 423 which is connected to the spring driving element 32, and a pointer arm 422 which is downwardly extended from the connecting arm 423 for selectively aligning with the resistance level scales 411.

Figure 11:
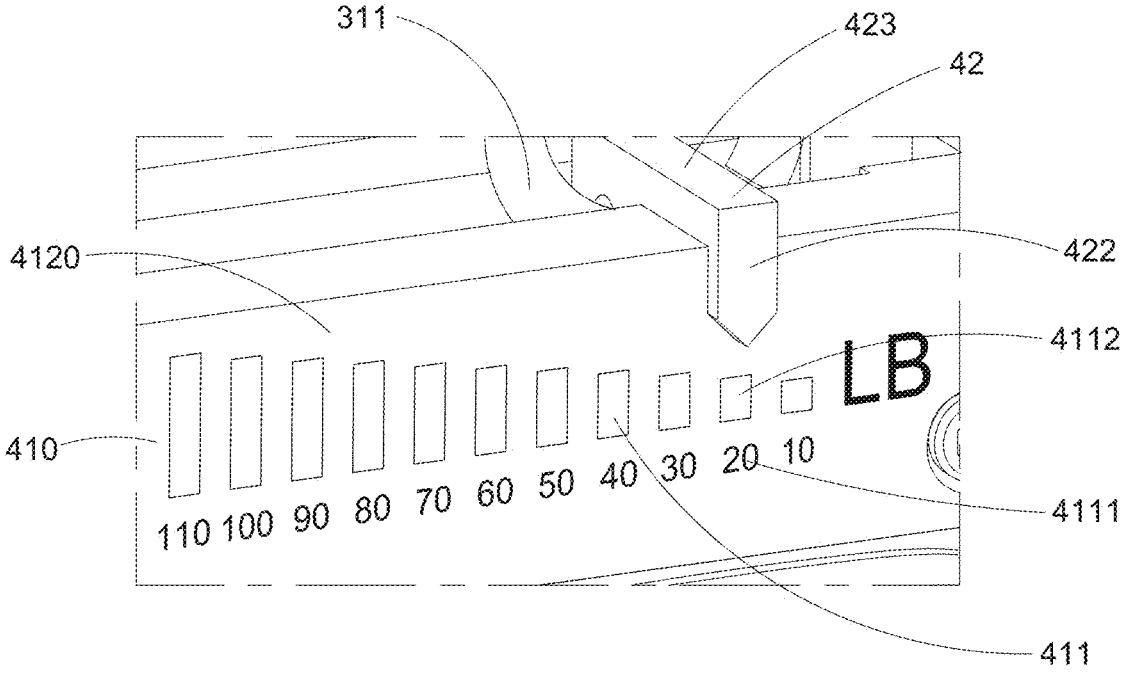
FIG. 11 is an partial enlarged view of area B in FIG. 10.
Figure 12:
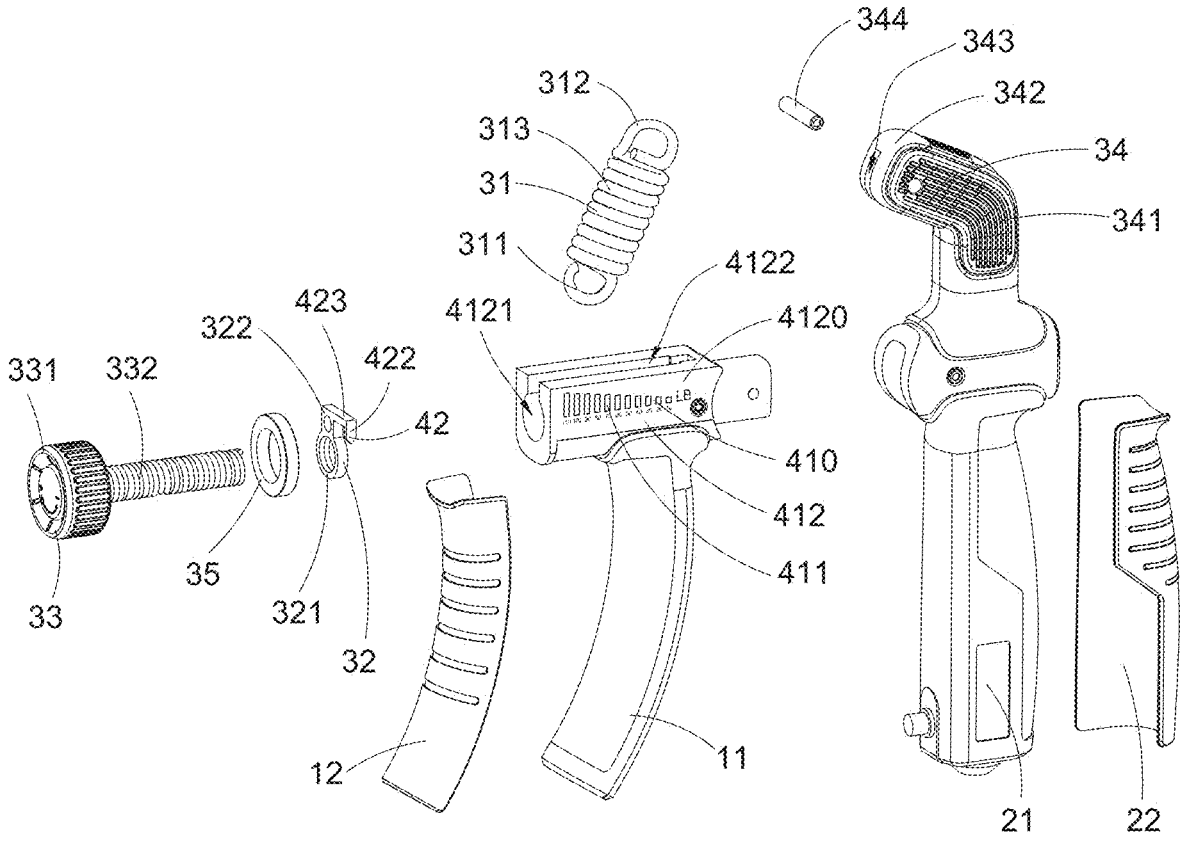
FIG. 12 is an exploded view illustrating the hand grip strengthener according to the seventh alternative mode of the above first preferred embodiment of the present invention.

More specifically, the connecting arm 423 can be transversely and integrally extended from the driving member 322 of the spring driving element 32. As shown in FIG. 11 of the drawings, the connecting arm 423 is extended at a position above the upper groove 4122 of the base arm 412, so that when the spring driving element 32 is moving along the channel 4121 of the base arm 412, the connecting arm 423 is moving above the upper groove 4122 of the base arm 412, the pointer arm 422 is simultaneously driving to move along the scale display area 410 of the scale display element 41.

As is shown in FIG. 11 of the drawings, the connecting arm 423 is spaced apart form a top of the base arm 412 of the scale display element 41, and the pointer arm 422 is spaced apart from the side surface 4120 of the base arm 412 of the scale display element 41, so that the smooth movement of the indication element 42 is ensured.

Alternatively, the connecting arm 423 may be provided with a rotating wheel which can be rotating and having contact with a top surface of the base arm 412, so that the movement of the indication element 42 will also be achieved.

Figure 13:
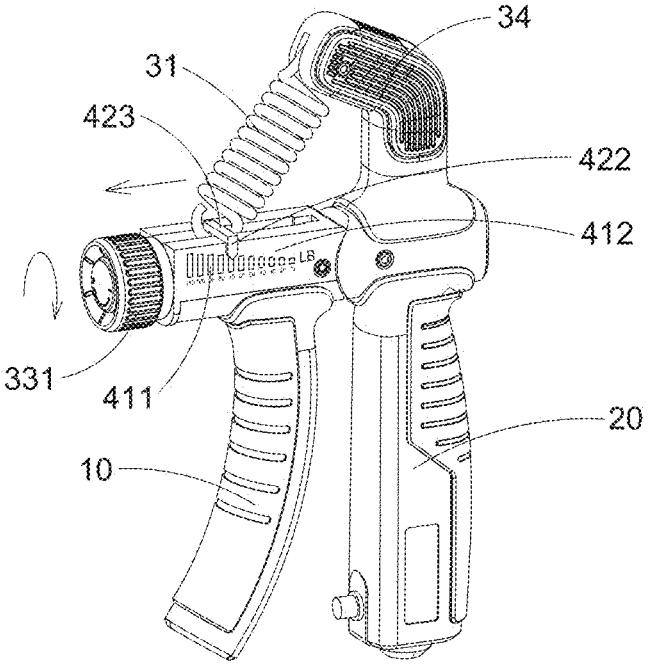
FIG. 13 is a perspective view illustrating the resistance level indication of the hand grip strengthener according to the seventh alternative mode of the above first preferred embodiment of the present invention.
Figure 14:
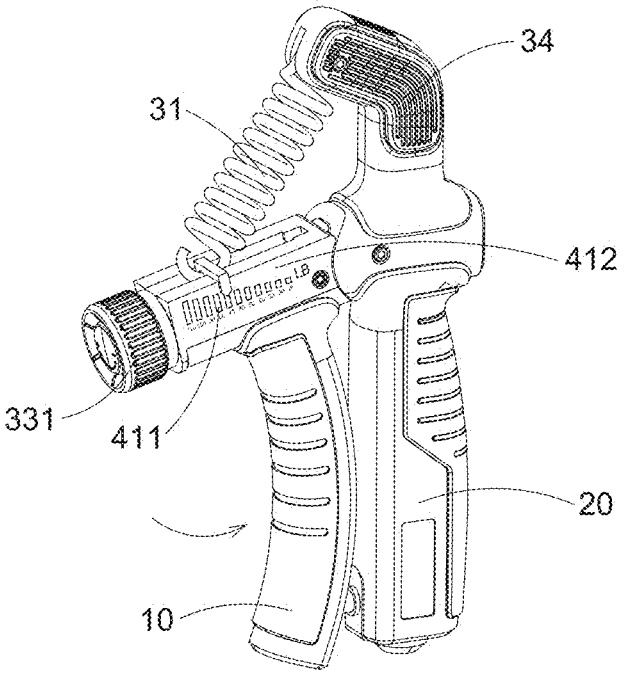
FIG. 14 is a perspective view illustrating the operation of the two operations arms of the hand grip strengthener according to the seventh alternative mode of the above first preferred embodiment of the present invention.

With referring to FIG. 11 and FIG. 13 of the drawings, the user can operate the adjusting knob 331, so as to drive the movement of the moving member 321 of the spring driving element by the driving shaft 332, so that the pointer arm 422 and the connecting arm 423 of the indication element 42 can be driven to move. When the pointer arm 422 and the connecting arm 423 are moved toward a position adjacent to the spring mounting element 34, the resistance of the spring element 31 applied to the relative movement of the first operation arm 10 and the second operation arm 20 is reduced, and the pointer arm 422 is aligned to a smaller scale value 4111 and a scale bar 4112 with a smaller length. When the pointer arm 422 and the connecting arm 423 are moved toward a position adjacent to the adjusting knob 331, the resistance of the spring element 31 applied to the relative movement of the first operation arm 10 and the second operation arm 20 is increased, and the pointer arm 422 is aligned to a larger scale value 4111 and a scale bar 4112 with a larger length.

Figure 15:
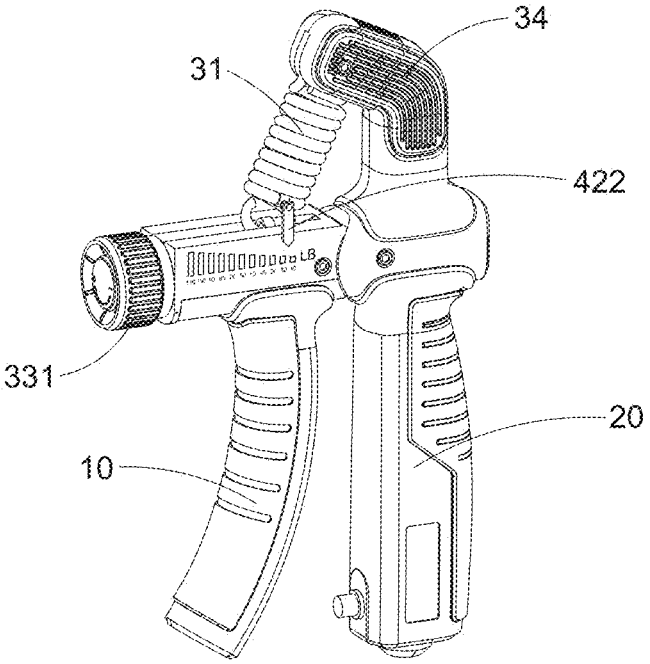
FIG. 15 is a perspective view illustrating a hand grip strengthener according to an eighth alternative mode of the above first preferred embodiment of the present invention.
Figure 16:
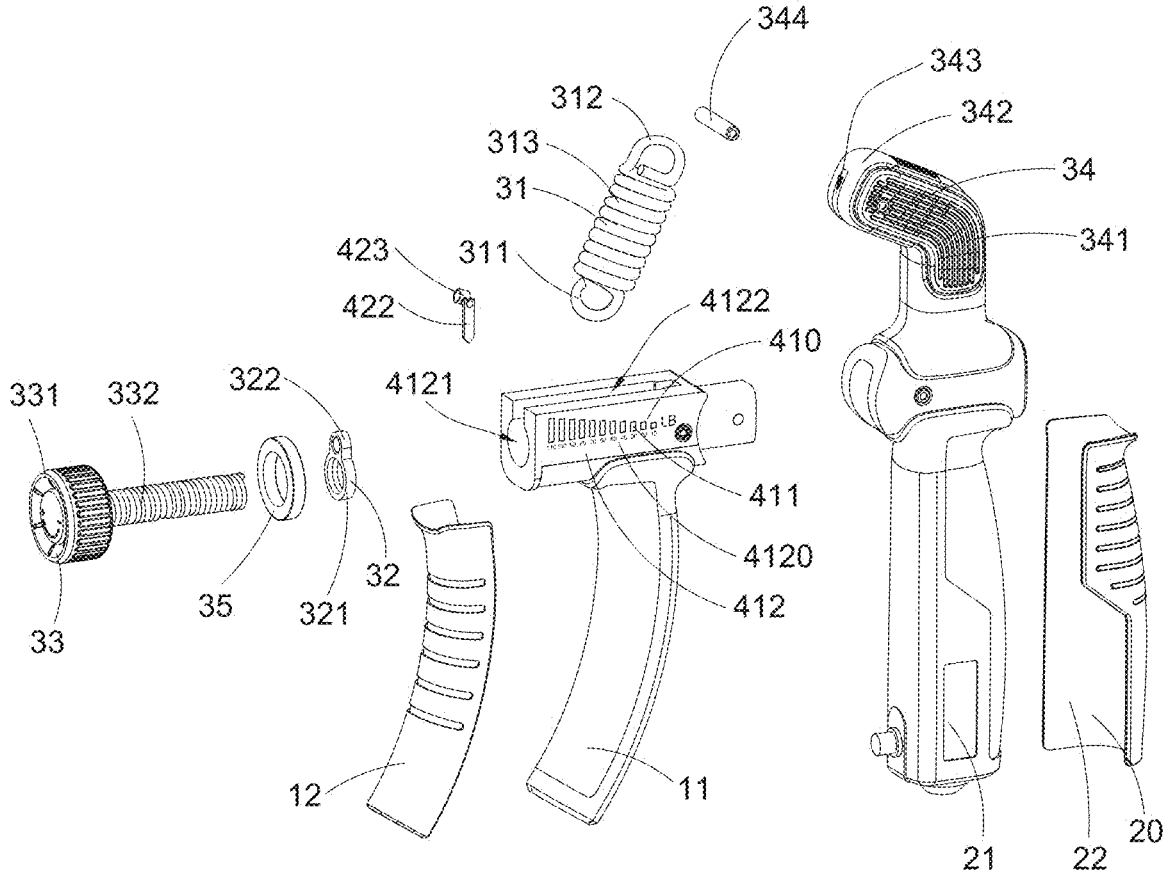
FIG. 16 is an exploded view illustrating the hand grip strengthener according to the eighth alternative mode of the above first preferred embodiment of the present invention.

Referring to FIGS. 15 and 16 of the drawings, according to an eighth alternative mode, the indication element 42 comprises a connecting arm 423 which is connected to the spring element 31, and a pointer arm 422 which is downwardly extended from the connecting arm 423 for selectively aligning with the resistance level scales 411. More specifically, the connecting arm 423 can be connected to a bottom thread of the spring body 313 of the spring element 31, so that when the spring element 31 is driven to move by the driving member 322 of the spring driving element 32, the movement of the spring element 31 will drive the movement of the connecting arm 423 and the pointer arm 422 of the indication element 42.

Figure 17:
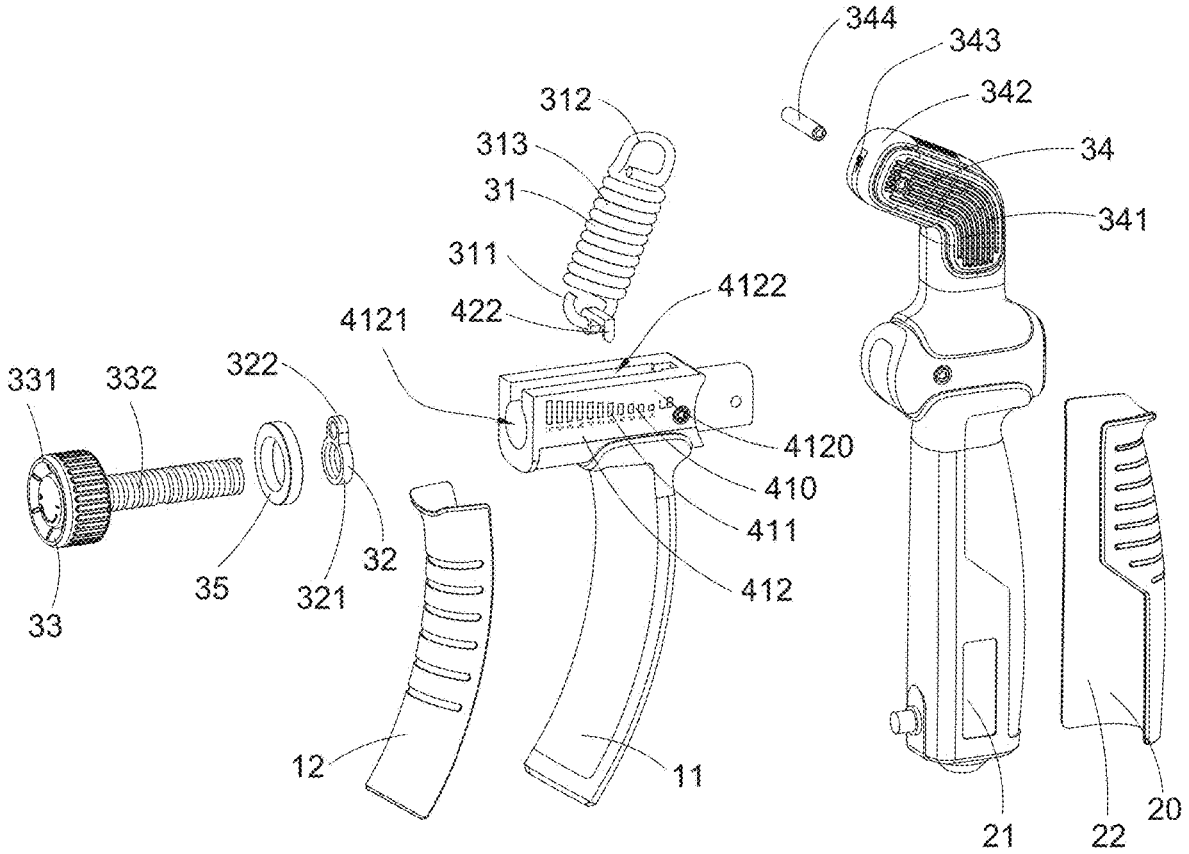
FIG. 17 is an exploded view illustrating the hand grip strengthener according to a ninth alternative mode of the above first preferred embodiment of the present invention.
Figure 18:
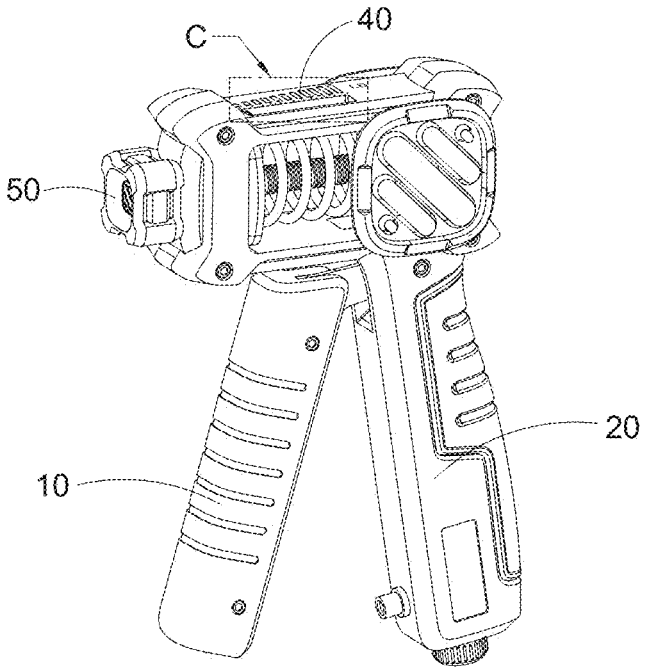
FIG. 18 is a perspective view illustrating a hand grip strengthener according to a second preferred embodiment of the present invention.

Alternatively, as shown in FIG. 17 of the drawings, the connecting arm 423 can be connected to the moving end portion 311 of the spring element 31, so that when the moving end portion 311 of the spring element 31 is driven to move by the driving member 322 of the spring driving element 32, the connecting arm 423 connected to the moving end portion 311 of the spring element 31 will be driven to move to cause the movement of the pointer arm 422 of the indication element 42 along the scale display area 410.

Referring to FIG. 18 to FIG. 22 of the drawings, a hand grip strengthener with resistance level indication according to a second preferred embodiment of the present invention is illustrated, wherein the hand grip strengthener comprises a first operation arm 10, a second operation arm 20, a strength adjustment assembly 50, and a resistance level indication assembly 40 which comprises a scale display element 41 and an indication element 42 for indicating a current resistance level to a user when the strength adjustment assembly 30 is operated for adjusting the resistance.

The first operation arm 10 is coupled with the second operation arm 20 for a hand of a user to grip thereon and the two operation arms 10 and 20 are capable of being moved away from or close to each other. The strength adjustment assembly 50 is coupled to one of the operations arms to adjust the resistance for the user, the scale display element 41 of the resistance level indication assembly 40 comprises a scale display area 410 for displaying a plurality of resistance level scales 411, and the indication element 42 can be driven to move during the strength adjustment process by the strength adjustment assembly 30, so as to allow the indication element 42 to point to a position within the scale display area 410, so that the user can view his or her current resistance level.

According to this embodiment, the strength adjustment assembly 50 comprises a spring element 51, a spring driving element 52, and an adjustment control element 53. The spring element 51 is arranged to generate a resistance force to the relative movement between the first operation arm 10 and the second operation arm 20, the adjustment control element 53 can be operated by the user, so as to drive the spring driving element 52 to move, and thus the spring element 51 is driven to move and deform, so as to adjust the elastic resistance force.

The strength adjustment assembly 50 further comprises a spring mounting piece 54 which is disposed in the scale display element 41. The spring element 51 comprises a moving end portion 511, a fixing end portion 512, and a spring body 513 extended between the moving end portion 511 and the fixing end portion 512. The fixing end portion 512 is an end portion that is opposite to the moving end portion 511 and is fixed to the spring mounting piece 54.

Figure 20:
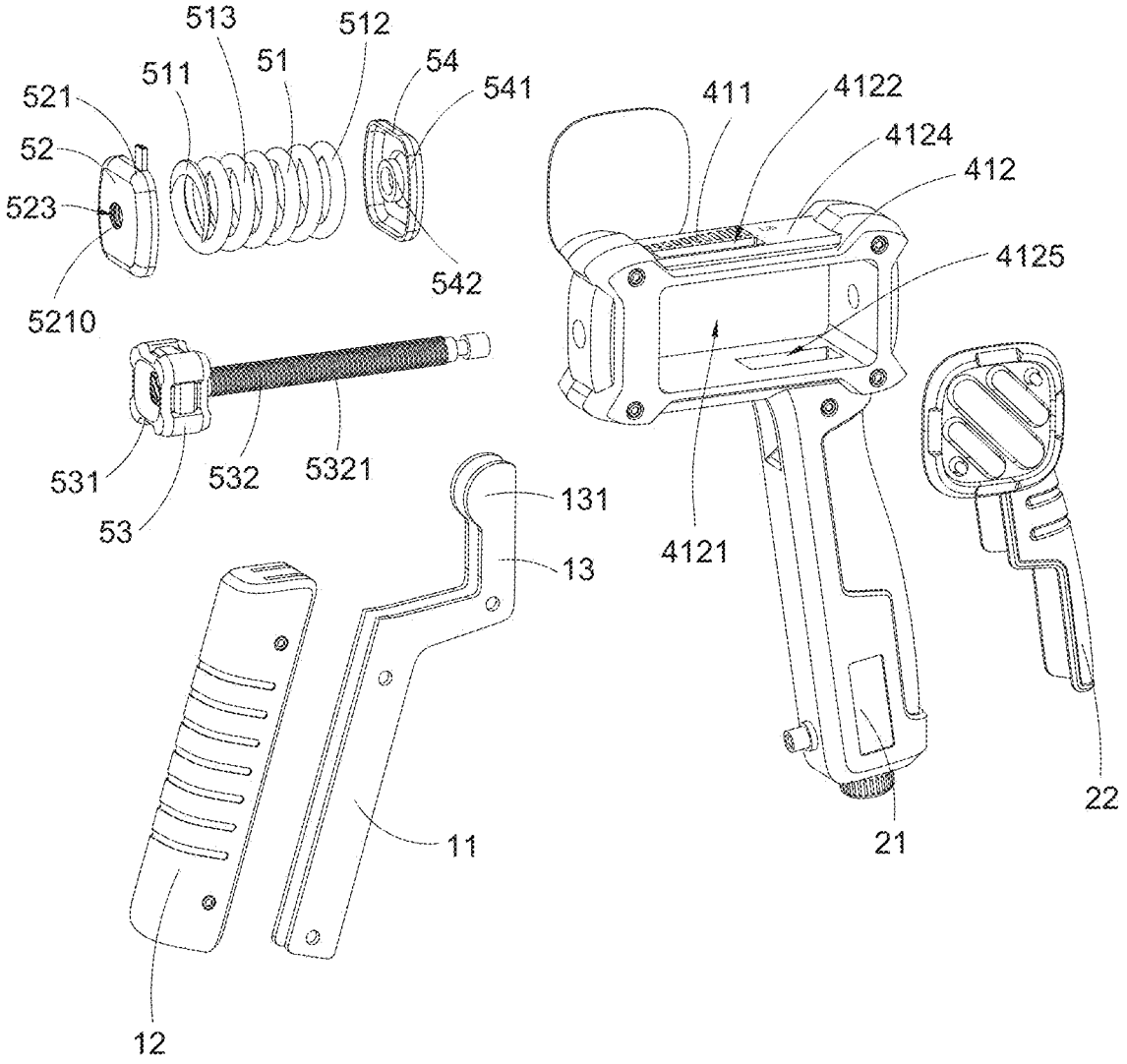
FIG. 20 is an exploded view of the hand grip strengthener according to the above second preferred embodiment of the present invention.

As shown in FIG. 20 of the drawings, the spring mounting piece 54 comprises a biasing part 541 for engaging with the first operation arm 10, and a central connecting part 542 for mounting with the fixing end portion 512 of the spring element 51.

The adjustment control element 53 comprises an adjusting knob 531 and a driving shaft 532 connected to the adjusting knob 531, the spring driving element 52 is movably coupled on the driving shaft 532 in a manner that when the adjusting knob 531 is rotated, the spring driving element 52 will be driven to move by the driving shaft 532, so as to further drive the moving end portion 511 of the spring element 51 to move, so that the spring body 513 is deformed into different tension states to generate different resistances to the relative movement between the first operation arm 10 and the second operation arm 20.

The driving shaft 532 comprises outer threads 5321 on an outer surface thereof, the spring driving element 52 comprises a moving member 521 wound around the driving shaft 532. The moving member 521 is a plate having a central hole 523 and comprises inner threads 5210 for engaging with the outer threads 5321 of the driving shaft 532, so that the moving member 521 is screwed on the driving shaft 532. Therefore, when the adjusting knob 51 is rotated, the driving shaft 532 will be rotating, and the moving member 521 will be driven to move along the driving shaft 532 because of the screwing connection between the driving shaft 532 and the moving member 521, and thus the moving end portion 511 of the spring element 51 connected to the moving member 521 will be driven to move to adjust its position to result in the deformation of the spring body 513, so that the compression state of the spring body 513 is adjusted, and thus the adjustable resistance of the hand grip strengthener can be provided.

In this embodiment, the spring element 51 also can be a compression spring, the movement of the moving end portion 511 of the spring element 31 will result in different compression states of the compression spring, so as to adjust the resistance of the spring element 51 applied to the relative movement between the first operation arm 10 and the second operation arm 20.

Figure 19:
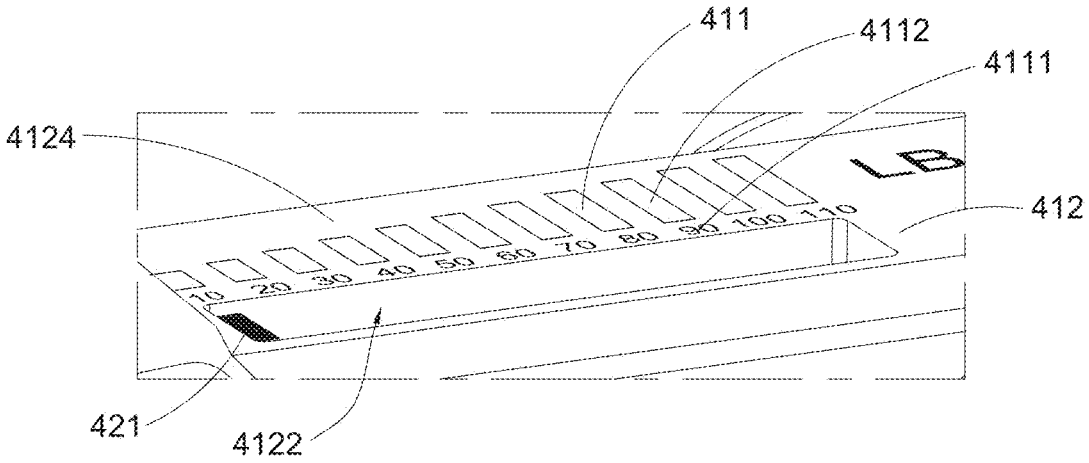
FIG. 19 is an partial enlarged view of area C in FIG. 18.

The scale display element 41 comprises a base arm 412 comprising a top surface 4124, the scale display area 410 is formed on the top surface 4124 of the base arm 412. As shown in FIG. 19 of the drawings, the plurality of resistance scale levels 411 can be marks spacedly painted on the top surface 4124 of the base arm 412.

According to this embodiment, the first operation arm 10 is operatively coupled to the spring element 51, the second operation arm 20 is connected to the base arm 412, so as to allow the first operation arm 10 and the second operation arm 20 to be moved close to each other or to be moved away from each other for hand strength exercising.

The first operation arm 10 comprises a first arm body 11, a first gripping layer 12 provided on the first arm body 11 to enhance slip resistance and provide a comfortable grip of the user, and a biasing arm 13 connected to the first arm body 11 for biasing against the biasing part 541 of the spring mounting piece 54. The second operation arm 20 comprises a second arm body 21 connected to the base arm 412 and a second gripping layer 22 provided on the second arm body 21 to enhance slip resistance and provide a comfortable grip of the user. Each of the first gripping layer 12 and the second gripping layer 22 can be made of a flexible material.

The base arm 412 has a channel 4121 and an upper groove 4122 communicated to the channel 4121, the driving shaft 332 of the adjustment control element 53 is extended into the channel 4121 of the base arm 412 and is movable in the channel 4121. In this embodiment, the upper groove 4122 is function as a window for facilitating the user to view the indication element 42 connected to the spring driving element 52. The spring element 51, the spring driving element 52 and the spring mounting piece 54 are disposed in the channel 4121 of the base arm 412.

The base arm 412 has a bottom hole 4125, an upper end portion 131 of the biasing arm 13 of the first operation arm 10 is extended into the channel 4121 of the base arm 412 through the bottom hole 4125, and the upper end portion 131 of the biasing arm 13 is biasing against the biasing part 541 of the spring mounting piece 541.

During an exercise operation of the hand grip strengthener, the second operation arm 20 can be supported in the palm of the user, while the fingers of the gripping hand of the user can be gripped on the first operation arm 10 to apply a pressing force to the first operation arm 10, the spring element 51 will apply a resistance to the movement of the first operation arm 10 through the biasing part 541 of the spring mounting piece 54 and the upper end portion 131 of the first operation arm 10. The biasing part 541 is slidably arranged on the driving haft 532, so that when the first operation arm 10 is pressed and operated by the fingers of the user, the upper end portion 131 of the biasing arm 13 of the first operation arm 10 forces the biasing part 541 to move towards the moving member 521, so as to compress the spring body 513 of the spring element 51, and thus the resistance will be created by the spring element 51. Alternatively, the user may user different fingers of an operating hand of the user to carry out the hand grip strength training.

As shown in FIG. 19 of the drawings, each of the resistance scale levels 411 may comprise a scale value 4111 and a scale bar 4112 for representing a magnitude of the resistance by its length. As the example shown in FIG. 19, the plurality of scale values 4111 can be ranged from 10 lbs to 110 lbs. In this embodiment, the minimum scale value 10 lbs is painted on the top surface 4124 of the base arm 412 at a side adjacent to the adjusting knob 531, i.e. the left side of the hand grip strengthener; the maximum scale value 110 lbs is painted on the top surface 4124 of the base arm 412 at a side adjacent to the biasing part 541 of the spring mounting piece 54, i.e. the right side of the hand grip strengthener.

The indication element 42 of this embodiment can be a color marking 421 which is formed on a top of moving member 521, so that when the moving member 521 is driven to move in the channel 4121 of the base arm 412 along the driving shaft 532 of the adjustment control element 53, the color marking 421 will be simultaneously driven to move along with the moving member 521 of the spring driving element 52, and thus the color marking 421 can be moved to align its position with one of the resistance level scales 411 or align its position to a middle position between two adjacent resistance level scales 411 when the movement of the spring driving element 52 and the color marking 421 is stopped, so that the user can know the precise resistance level he or she is working with.

The color marking 421 can be but not limited to a red marking, a green marking, a yellow marking, white marking, a blue marking, a brown marking, a purple marking, or a black marking. The color marking 421 is applied on the moving member 521 with a color that is different from the driving shaft 532 of the adjustment control element 53, so that the color marking 421 is distinguishable from the driving shaft 532, making it easy to be recognized by the user. Furthermore, it preferred that color marking 421 has a color that is different from the base arm 412 of the scale display element 41, so that the color marking 421 is distinguishable from the base arm 412 of the scale display element 41. In addition, it is further preferred that the color of the color marking 421 is distinguishable from the resistance level scales 411, so that the user is able to identify the color marking 421 from the resistance level scales 411.

Figure 21:
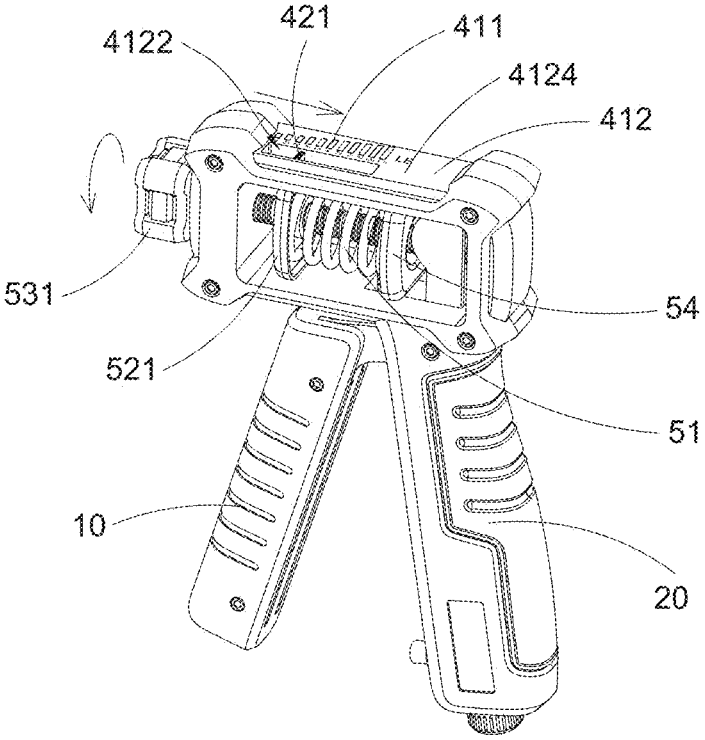
FIG. 21 is a perspective view illustrating the resistance level indication of the hand grip strengthener according to the above second preferred embodiment of the present invention.
Figure 22:
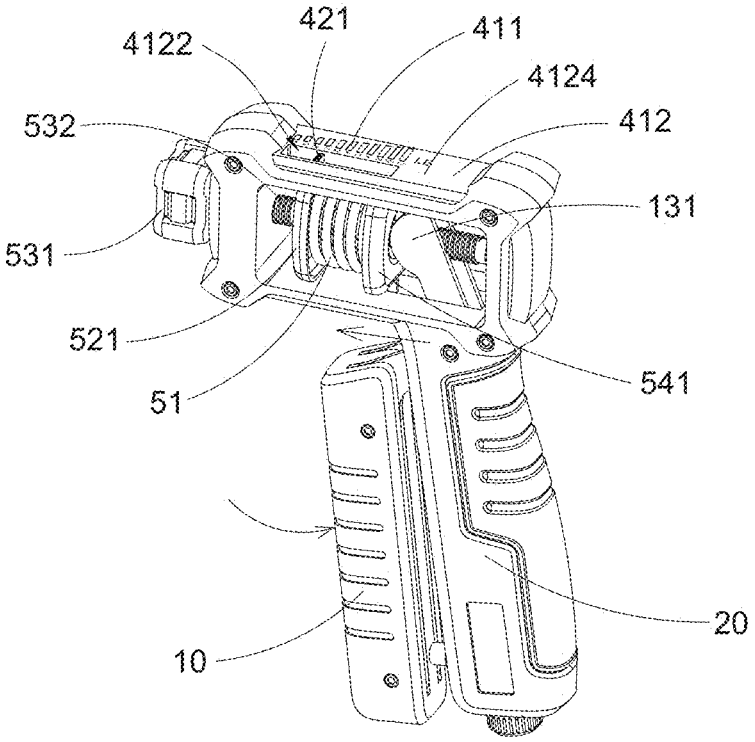
FIG. 22 is a perspective view illustrating the operation of the two operation arms of the hand grip strengthener according to the above second preferred embodiment of the present invention.

With reference to FIGS. 19 and 21 of the drawings, when the color marking 421 and the moving member 521 is moved toward the adjusting knob 531, the resistance of the spring element 31 applied to the movement of the first operation arm 10 is reduced, and the color marking 421 is aligned to a smaller scale value 4111 and a scale bar 4112 with a smaller length. When the color marking 421 and the moving member 521 is moved toward the biasing part 541 of the spring mounting piece 54, the spring element 51 is gradually compressed, so that the resistance of the spring element 51 applied to the movement of the first operation arm 10 is increased, and the color marking 421 is aligned to a larger scale value 4111 and a scale bar 4112 with a larger length.

Figure 23:
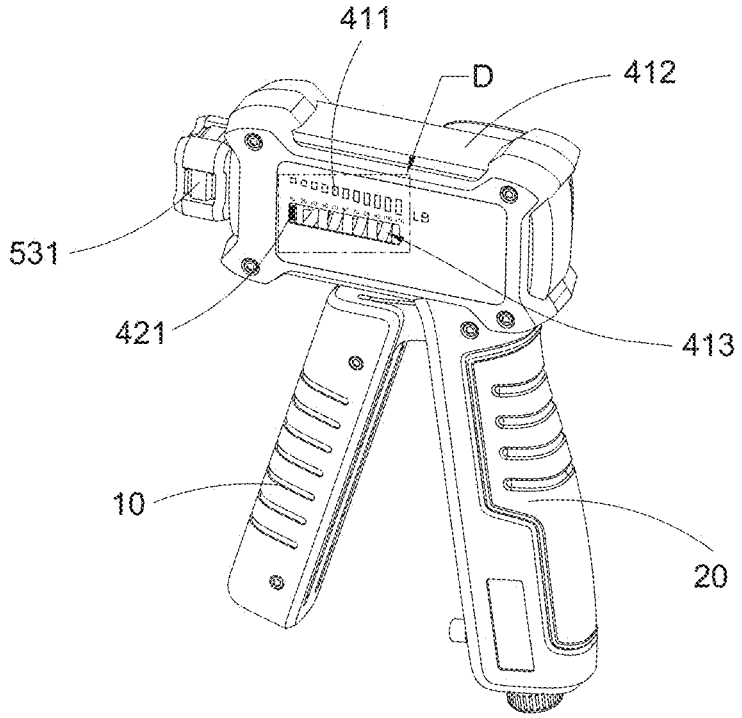
FIG. 23 is a perspective view illustrating a hand grip strengthener according to a first alternative mode the above second preferred embodiment of the present invention.
Figure 24:
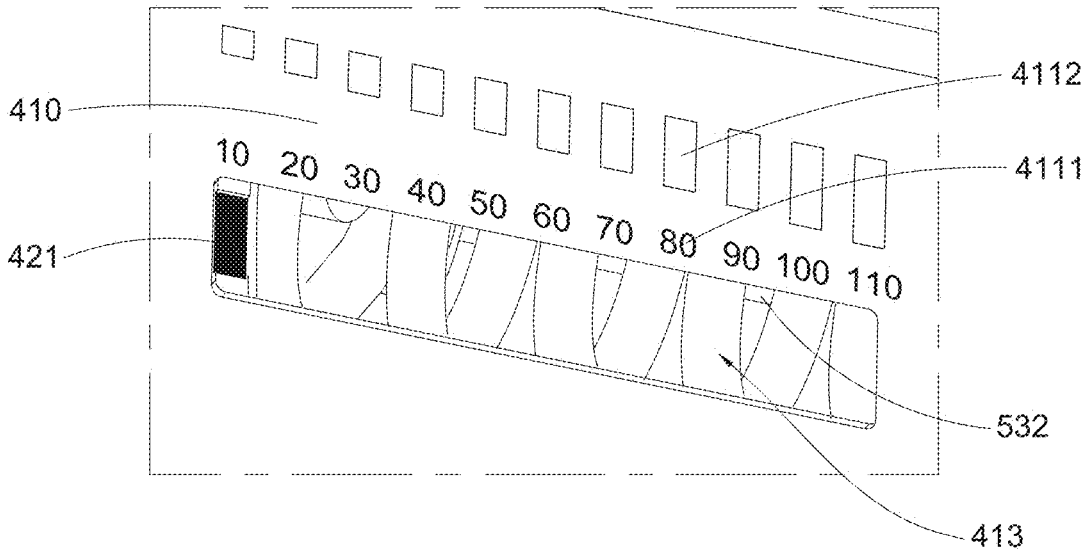
FIG. 24 is an partial enlarged view of area D in FIG. 23.
Figure 25:
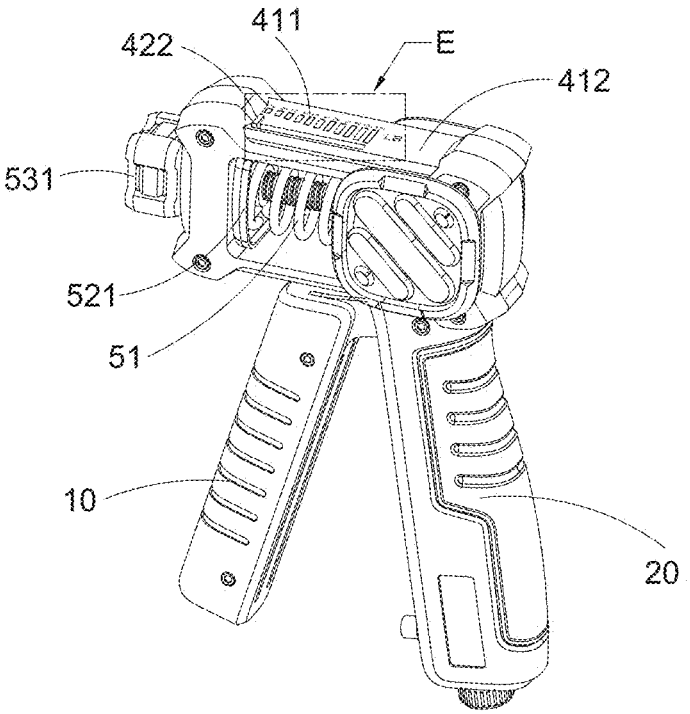
FIG. 25 is a perspective view illustrating a hand grip strengthener according to a second alternative mode the above second preferred embodiment of the present invention.
Figure 26:
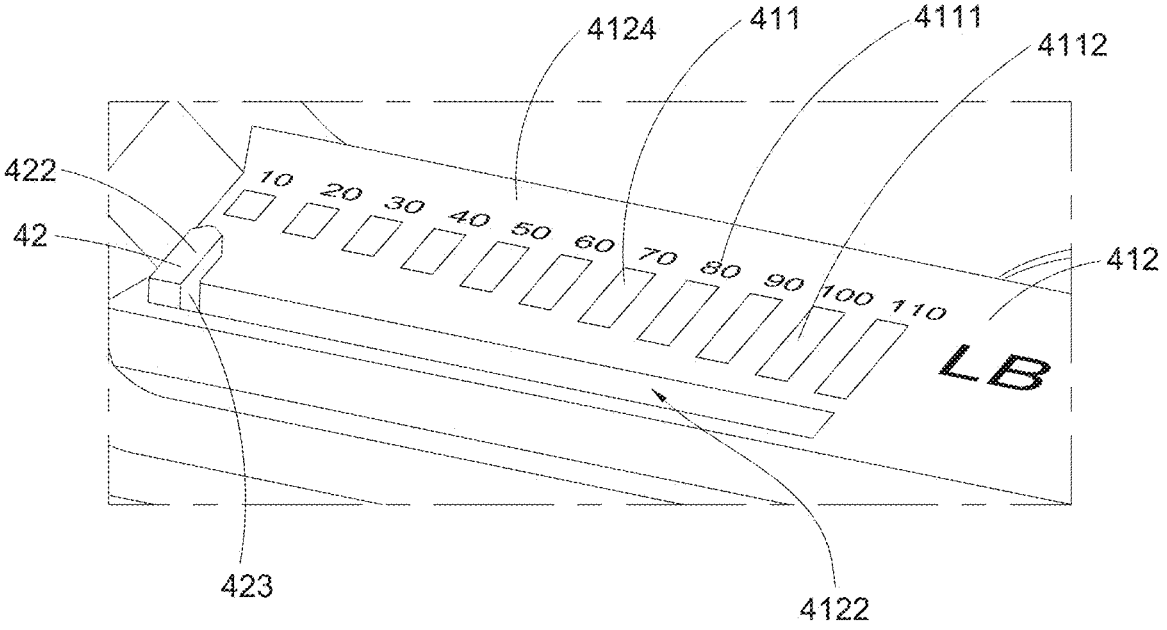
FIG. 26 is an partial enlarged view of area E in FIG. 25.
Figure 27:
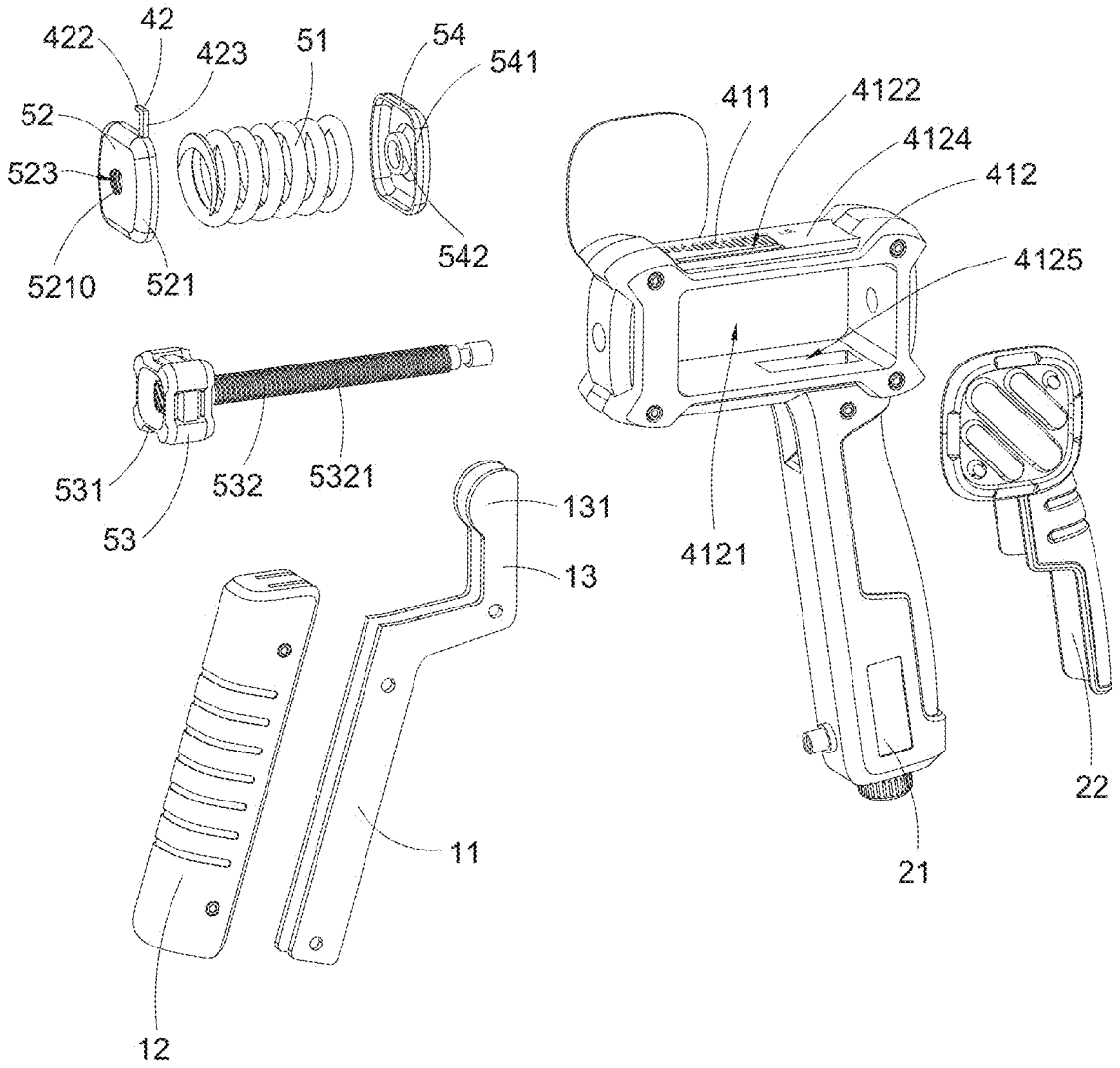
FIG. 27 is a perspective view of the hand grip strengthener according to the second alternative mode the above second preferred embodiment of the present invention.
Figure 28:
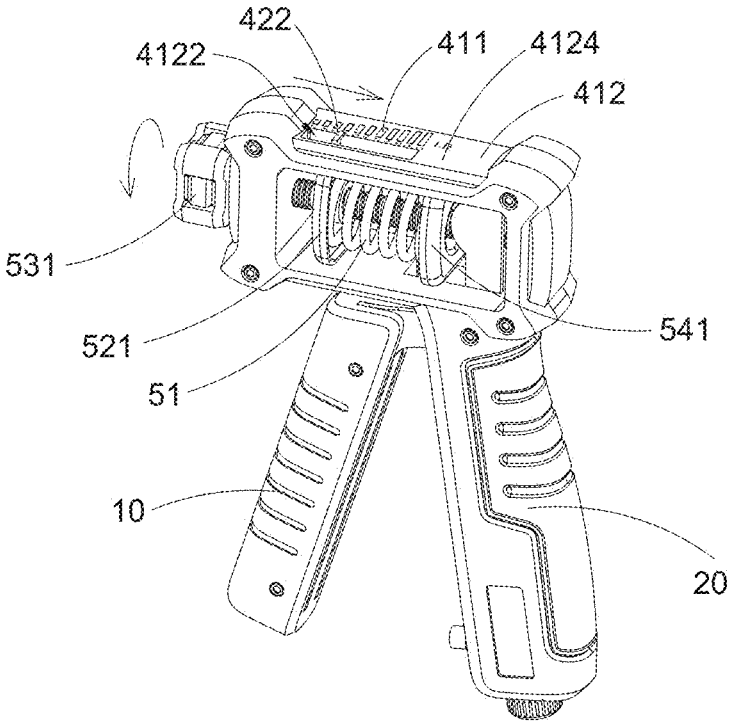
FIG. 28 is a perspective view illustrating the resistance level indication of the hand grip strengthener according to the second alternative mode of the above second preferred embodiment of the present invention.
Figure 29:
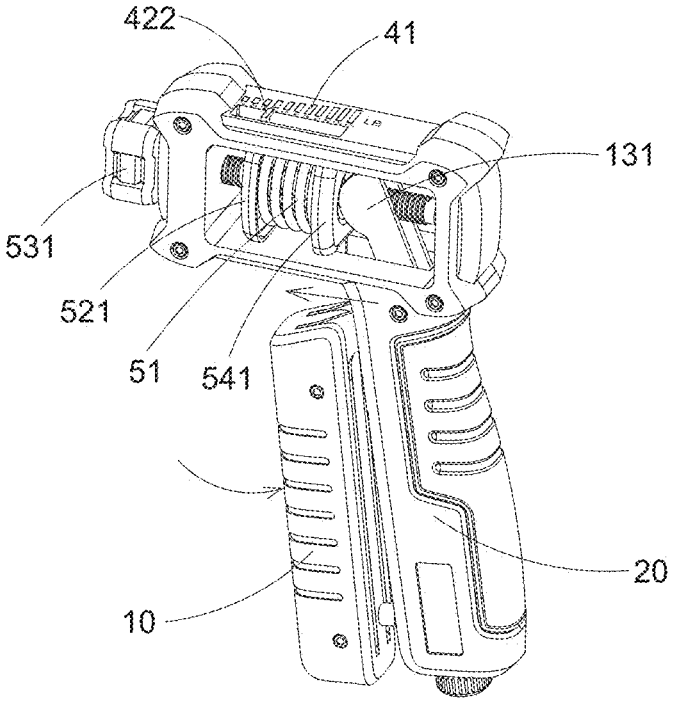
FIG. 29 is a perspective view illustrating the operation of the two operation arms of the hand grip strengthener according to the second alternative mode of the above second preferred embodiment of the present invention.

Referring to FIG. 23 and FIG. 24 of the drawings, as a first alternative mode of the second preferred embodiment, the base arm 412 has a window 413 formed at a side thereof, the indication element 42 comprises a color marking 421 which is provided on a side surface of the moving member 521 facing towards the window 413. The plurality of resistance level scales 411 is provided on a side surface of the bar arm 412.

Referring to FIGS. 25 to 29 of the drawings, as a second alternative mode of the second preferred embodiment, the indication element 42 is embodied to comprise a pointer arm 422 which is identifiable by its own shape or configuration. For example, in this embodiment, a part of the pointer arm 422 is shaped like an arrow.

More specifically, the indication element 42 comprises a connecting arm 423 which is vertically extended from the moving member 521 and is movable in the upper groove 4122 of the base arm 412, the pointer arm 422 is transversely extended from the connecting arm 423 at a position spaced apart from the top surface 4124 of the base arm 412 and is preferred to be parallel with the scale display area 410 of the base arm 412. The plurality of resistance level scales 411 is painted on the top surface 4124 of the base arm 412. When the moving member 521 is driven to move by operating the adjusting knob 331, the connecting arm 423 is driven to move in the upper groove 4122 of the base arm 412, so that the position of the pointer arm 422 is moved to be selectively aligned with the resistance level scales 411.

Figure 30:
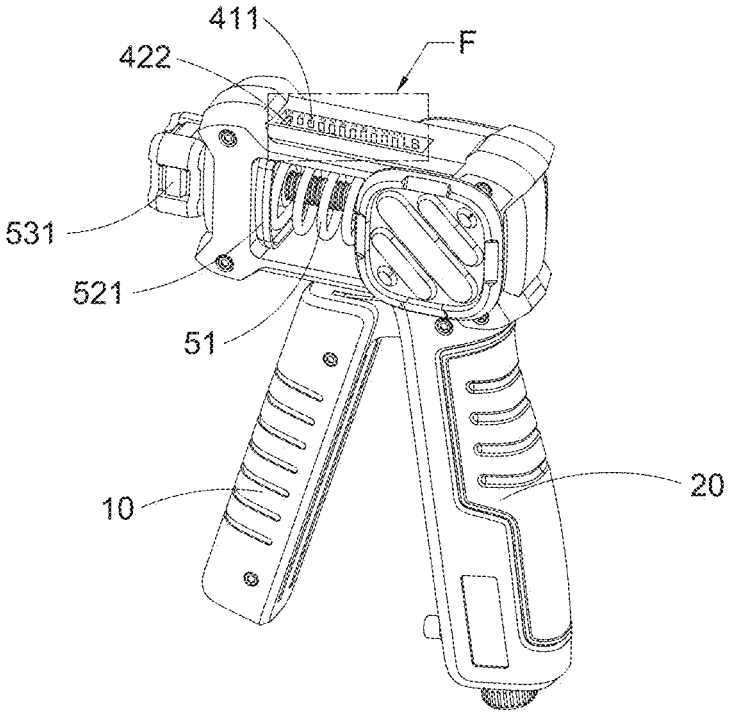
FIG. 30 is a perspective view illustrating a hand grip strengthener according to a third alternative mode the above second preferred embodiment of the present invention.
Figure 31:
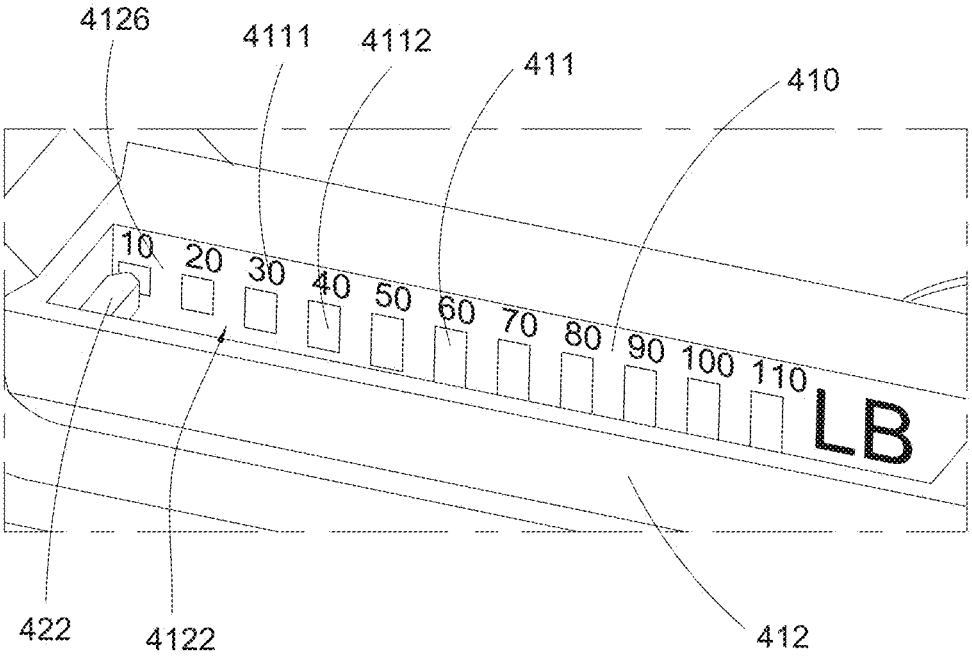
FIG. 31 is an partial enlarged view of area F in FIG. 30.

Referring to FIG. 30 and FIG. 31 of the drawings, as a third alternative mode of the second preferred embodiment, the indication element 42 comprises a connecting arm 423 which is vertically extended from the moving member 521 and is movable in the base arm 412, and a pointer arm 422 which is transversely extended from the connecting arm 423 and is arranged to be movable in the upper groove 4122.

The base arm 412 has two groove walls 4126 for defining the upper groove 4122, the plurality of resistance level scales 411 is painted on one of the groove walls 4126 of the base arm 412. When the moving member 521 is driven to move by operating the adjusting knob 331, the connecting arm 423 is driven to move in the base arm 412, so that the pointer arm 422 is driven to move in the upper groove 4122, so as to be selectively aligned with the resistance level scales 411 formed on the corresponding groove wall 4126 to inform the user about the current resistance level.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A hand grip strengthener, comprising:

a first operation arm;

a second operation arm;

a strength adjustment assembly comprising a spring element, a spring driving element, and an adjustment control element, wherein said spring element is arranged to generate a resistance force to the relative movement between said first operation arm and said second operation arm, wherein when said adjustment control element is operated by the user, said spring driving element is driven to move, so as to drive said spring element to move to adjust the resistance force, wherein said adjustment control element comprises an adjusting knob and a driving shaft coupled to said adjusting knob, wherein said spring driving element comprises a moving member which is screwed on said driving shaft in a manner that when said adjusting knob is rotated, said driving shaft is rotating to drive said moving member to move, so as to drive said spring element to move;

a scale display element comprising a base arm and a plurality of resistance level scales provided on said base arm; and an indication element which is arranged to be driven by said moving member to move along with the movement of said spring driving element, so as to be selectively aligned with said plurality of resistance level scales;

wherein said base arm comprises:

a channel for receiving said moving member therein in a slidably movable manner; and an elongated window, which is a through window, extended along a length of said base arm to communicate with said channel, wherein said indication element is moved and displayed along said elongated window to precisely indicate a movement of said moving member along said channel so as to precisely align said indication element with one of said resistance level scales.

2. The hand grip strengthener, as recited in claim 1, wherein said elongated window has two ends formed at two end portions of said base arm, such that when said moving member is moved along said channel via said driving shaft, said moving member, said driving shaft and said indication element are displayed along said elongated window between said two ends.

3. The hand grip strengthener, as recited in claim 2, wherein said indication element is integrally provided on said moving member at a side facing toward said elongated window.

4. The hand grip strengthener, as recited in claim 3, wherein said indication element comprises a color marking coated on said moving member to be displayed through said elongated window.

5. The hand grip strengthener, as recited in claim 4, wherein said moving member comprises a ring body which is wound around said driving shaft, and a protruding block which is integrally extended from said ring body and is extended into said elongated window, such that when said ring body is moved along said channel, said protruding block is moved along said elongated window, wherein said color marking is formed on said protruding block.

6. The hand grip strengthener, as recited in claim 5, wherein said protruding block has a flat surface facing toward and positioned within said elongated window, wherein said color marking is formed on said flat surface of said protruding block.

7. The hand grip strengthener, as recited in claim 6, wherein said indication element and said moving member are disposed in said channel at an inner side of said elongated window.

8. The hand grip strengthener, as recited in claim 6, wherein said color marking is provided in said elongated window, so as to move in said elongated window.

9. The hand grip strengthener, as recited in claim 3, wherein said indication element comprises a pointer arm integrally connected to said moving member.

10. The hand grip strengthener, as recited in claim 9, wherein said pointer arm and said moving member are disposed in said channel, so as to be driven to move in said channel.

11. The hand grip strengthener, as recited in claim 9, wherein said pointer arm is extended into said elongated window, so as to be driven to move in said elongated window, said moving member is disposed in said channel, so as to be driven to move in said channel.

12. The hand grip strengthener, as recited in claim 4, wherein said indication element comprises a connecting arm connected to said moving member and a pointer arm transversely connected to said connecting arm, wherein said connecting arm is penetrating through said elongated window to allow said pointer arm to be provided at an outer side of said base arm, such that said pointer arm are moved out of said elongated window.

13. The hand grip strengthener, as recited in claim 1, wherein said indication element comprises a pointer arm not only connected to said spring element but also extended through said elongated window from said channel.

14. The hand grip strengthener, as recited in claim 1, wherein said base arm has an upper groove communicated to said channel, wherein said indication element comprises a connecting arm connected to said spring driving element and a pointer arm downwardly extended from said connecting arm, wherein said pointer arm is extended out of said upper groove and is provided at a position at an outer side of said base arm, wherein said plurality of resistance level scales is provided on a side surface of said base arm corresponding to said pointer arm.

15. The hand grip strengthener, as recited in claim 1, wherein said base arm has an upper groove communicated to said channel, wherein said indication element comprises a connecting arm connected to a connecting end of said spring element and a pointer arm downwardly extended from said connecting arm, wherein said pointer arm is extended out of said upper groove and is provided at a position at an outer side of said base arm, wherein when said indication element is driven to slide along said upper groove, said connecting end of said spring element is correspondingly moved along said upper groove, wherein said plurality of resistance level scales is provided on a side surface of said base arm corresponding to said pointer arm.

16. The hand grip strengthener, as recited in claim 1, wherein said strength adjustment assembly further comprises a spring mounting element which is connected to a top of said second operation arm, wherein said spring element is inclined connected between said spring driving element and said spring mounting element.

17. The hand grip strengthener, as recited in claim 16, wherein said first operation arm is connected to said base arm, wherein said base arm is movably connected to said second operation arm.

18. A hand grip strengthener, comprising:

a first operation arm;

a second operation arm;

a strength adjustment assembly comprising a spring element, a spring driving element, and an adjustment control element, wherein said spring element is arranged to generate a resistance force to the relative movement between said first operation arm and said second operation arm, wherein when said adjustment control element is operated by the user, said spring driving element is driven to move, so as to drive said spring element to move to adjust the resistance force, wherein said adjustment control element comprises an adjusting knob and a driving shaft coupled to said adjusting knob, wherein said spring driving element comprises a moving member which is screwed on said driving shaft in a manner that when said adjusting knob is rotated, said driving shaft is rotating to drive said moving member to move, so as to drive said spring element to move;

a scale display element comprising a base arm and a plurality of resistance level scales provided on said base arm; and an indication element which is arranged to be driven by said moving member to move along with the movement of said spring driving element, so as to be selectively aligned with said plurality of resistance level scales;

wherein said base arm comprises:

a channel for receiving said moving member therein in a slidably movable manner;

an elongated window which is a through window extended along a length of said base arm; and a transparent cover which is disposed into said elongated window, so as to cover said elongated window while still allow said indication element to be viewable from an outer side of said scale display element, wherein said indication element is moved and displayed along said elongated window to precisely indicate a movement of said moving member along said channel so as to precisely align said indication element with one of said resistance level scales.

* * * * *